US008581485B2

(12) United States Patent
Ono et al.

(10) Patent No.: US 8,581,485 B2
(45) Date of Patent: Nov. 12, 2013

(54) IMAGE DISPLAY APPARATUS

(75) Inventors: Shinya Ono, Shiga (JP); Yoshinao Kobayashi, Shiga (JP); Shinji Takasugi, Shiga (JP)

(73) Assignee: LG Display Co., Ltd., Seoul (KR)

( * ) Notice: Subject to any disclaimer, the term of this patent is extended or adjusted under 35 U.S.C. 154(b) by 231 days.

(21) Appl. No.: 12/816,264

(22) Filed: Jun. 15, 2010

(65) Prior Publication Data

US 2010/0253609 A1 Oct. 7, 2010

Related U.S. Application Data

(60) Division of application No. 11/589,868, filed on Oct. 31, 2006, now Pat. No. 7,944,416, which is a continuation of application No. PCT/JP2005/009279, filed on May 20, 2005.

(30) Foreign Application Priority Data

May 20, 2004 (JP) ..... 2004-151041
May 20, 2004 (JP) ..... 2004-151042

(51) Int. Cl.
*H01J 1/62* (2006.01)

(52) U.S. Cl.
USPC ..... 313/498; 345/76

(58) Field of Classification Search
USPC ..... 345/76; 313/498
See application file for complete search history.

(56) References Cited

U.S. PATENT DOCUMENTS

| | | | | |
|---|---|---|---|---|
| 6,229,506 | B1 | 5/2001 | Dawson et al. | |
| 7,154,454 | B2 | 12/2006 | Okabe et al. | |
| 7,259,737 | B2 | 8/2007 | Ono et al. | |
| 2004/0000865 | A1 * | 1/2004 | Yamazaki | 313/506 |
| 2004/0070557 | A1 | 4/2004 | Asano et al. | |
| 2004/0174354 | A1 | 9/2004 | Ono et al. | |
| 2004/0263741 | A1 * | 12/2004 | Koyama et al. | 349/139 |
| 2006/0208971 | A1 * | 9/2006 | Deane | 345/76 |

FOREIGN PATENT DOCUMENTS

| | | | |
|---|---|---|---|
| CN | 1460240 | A | 12/2003 |
| JP | 2002-514320 | A | 5/2002 |
| JP | 2002-196704 | A | 7/2002 |
| JP | 2004-133240 | A | 4/2004 |
| JP | 2004-280059 | A | 10/2004 |
| JP | 2004-341359 | A | 12/2004 |

OTHER PUBLICATIONS

Machine Translated Murao (JP 2002-196704).*
Dawson et al., "A Polysilicon Active Matrix Organic Light Emitting Diode Display with Integrated Drivers", ISSN0099-0966X/99/3001-0180 SID pp. 1-4 (1999).

(Continued)

*Primary Examiner* — Anh Mai
*Assistant Examiner* — Andrew Coughlin
(74) *Attorney, Agent, or Firm* — Birch, Stewart, Kolasch & Birch, LLP

(57) ABSTRACT

According to one embodiment, an image display apparatus includes a plurality of pixels. Each pixel has a light emitting device; a drive transistor electrically connected to the light emitting device; and a capacitor electrically connected to the drive transistor. A ratio of an area occupied by the drive transistor per one pixel to an area of the one pixel is equal to or more than 0.05.

20 Claims, 31 Drawing Sheets

(56) References Cited

OTHER PUBLICATIONS

Dawson et al., "Design of an Improved Pixel for Polysilicon Active-Matrix Organic LED Display", Society of Information Display 1998 Digest pp. 11-14 (1998).

Ono et al., "Pixel Circuit for a-Si AM-OLED", IDW pp. 255-258 (Dec. 3, 2003).

Sanford et al., Vt Compensation Performance of Voltage Data AMOLED Pixel Circuits: Proc. of IDRC 03, SID, pp. 38-41 (2003).

* cited by examiner

IMAGE DISPLAY APPARATUS

CROSS-REFERENCE TO RELATED APPLICATIONS

This application is a divisional application of application Ser. No. 11/589,868 filed on Oct. 31, 2006 now U.S. Pat. No. 7,944,416, which is a continuation of PCT international application Ser. No. PCT/JP05/09279 filed on May 20, 2005, and which is based upon and claims the benefit of priority from Japanese Patent Application No. 2004-151041 filed on May 20, 2004 and Japanese Patent Application No. 2004-151042 filed on May 20, 2004, the entire contents of which are incorporated herein by reference.

BACKGROUND OF THE INVENTION

1. Field of the Invention

The present invention relates to an image display apparatus, and specifically, to an image display apparatus capable of improving contrast.

2. Description of the Related Art

Conventionally, image display apparatuses using organic EL (electroluminescence) devices, which have a function of generating light by emission due to recombination of holes and electrons injected in an emission layer, have been proposed.

For example, such an image display apparatus includes plural pixel circuits arranged in a matrix form, a data line drive circuit for supplying brightness signals, which will be described later, to the plural pixel circuits via plural data lines, and a scan line drive circuit for supplying scan signals to the pixel circuits via plural scan lines. The scan signals are signals for selecting pixel circuits to which brightness signals are supplied via the data lines.

Further, the pixel circuit (for one pixel) has a function of emitting light by current injection and includes a light emitting device as the above-described organic EL device, a driver device for controlling current flowing in the light emitting device, and two or three switching devices. These driver device and switching devices are thin-film transistors (TFTs). Accordingly, the conventional image display apparatus has three-TFT configuration having three thin-film transistors (one driver device+two switching devices) or four-TFT configuration having four thin-film transistors (one driver device+three switching devices), for one pixel circuit.

FIG. 15A shows a configuration of a main part of an image display apparatus (for one pixel) proposed in Dawson et al., "Design of an Improved Pixel for Polysilicon Active-Matrix Organic LED Display", Society of Information Display 1998 Digest, 1998, p. 11-14 (hereinafter, referred to as "Dawson et al"). In the image display apparatus shown in FIG. 15A, a data line supply circuit 102 has a function of supplying a brightness signal via a data line 101. A scan line drive circuit 104 has a function of supplying a scan signal for selecting a pixel circuit for supplying a brightness potential via a scan line 103. A power supply circuit 105 has a function of supplying a high-level potential to one electrode of a capacitor 112 and an electrode of a switching device 108. A reset control circuit 114 supplies a reset potential to a switching device 109 via a reset line 115. A drive control circuit 116 supplies a control signal to a switching device 118 via a drive control line 117.

Further, in the image display apparatus, a light emitting device 107, the driver device 108, the switching device 109, the capacitor 112, the switching device 118, a capacitor 119, and a switching device 122 form a pixel circuit for one pixel. The light emitting device 107 has a mechanism of emitting light by current injection and consists of the above-described organic EL device. The switching device 108 has a function of controlling current flowing in the light emitting device 107.

The driver device 108 has a function of controlling the current flowing through the light emitting device 107 according to the potential difference equal to or more than the drive threshold value applied between a gate electrode corresponding to a first terminal a source electrode corresponding to a second terminal, and a function of keeping the current flow through the light emitting device 107 during application of the potential difference. The driver device 108 consists of a p-type thin-film transistor and controls the emission brightness of the light emitting device 107 according to the potential difference applied between the gate electrode and the source electrode.

FIG. 18A shows a configuration of a main part (for one pixel) of an image display apparatus having two-TFT configuration proposed in J. L. Sanford et al., Proc. of IDRC 03 p. 38. Further, FIG. 18B shows a time chart for explanation of the operation thereof. In the image display apparatus shown in FIG. 18A, a switching device T1, a driver device T2, a capacitor Cs, and a light emitting device OLED are connected as shown in the drawing to form two-TFT configuration (switching device T1 and driver device T2). The switching device T1 and driver device T2 are thin-film transistors.

However, in the image display apparatus as proposed in Dawson et al, there has been a problem of reduction in contrast because the light emitting device emits light in the reset step resetting the potential applied to the gate electrode of the driver device at the time of previous light emission.

Thus, in the image display apparatus as described by J. L. Sanford et al, there are cases where current flows through the light emitting device OLED in the reset step. That is, such an image display apparatus having two-TFT configuration is not applied to practical use.

Accordingly, there has been a problem that the conventional image display apparatus still adopts three-TFT configuration or four-TFT configuration for practical use and the improvement in definition is difficult.

SUMMARY OF THE INVENTION

An image display apparatus according to one aspect of the present invention includes a plurality of pixels, each pixel having a light emitting device, a drive transistor electrically connected to the light emitting device, and a capacitor electrically connected to the drive transistor. A ratio of an area occupied by the drive transistor per one pixel to an area of the one pixel is equal to or more than 0.05.

An image display apparatus according to another aspect of the present invention includes a plurality of pixels, each pixel having a light emitting device, a drive transistor electrically connected to the light emitting device, and a capacitor electrically connected to the drive transistor, the drive transistor and the capacitor not overlapping. A ratio of an area occupied by the capacitor per one pixel to an area of the one pixel is equal to or more than 0.05.

BRIEF DESCRIPTION OF THE DRAWINGS

FIG. 4 shows transient response characteristics after the first switching device 13 shown in FIG. 3A is turned ON;

FIG. 17 shows transient response characteristics after a switching device 109 and a driver device 108 shown in FIG. 15A are turned ON;

FIG. 19D shows a light-emitting step of the image display apparatus shown in

FIG. 18A.

DETAILED DESCRIPTION OF THE PREFERRED EMBODIMENTS

Figure 15A:
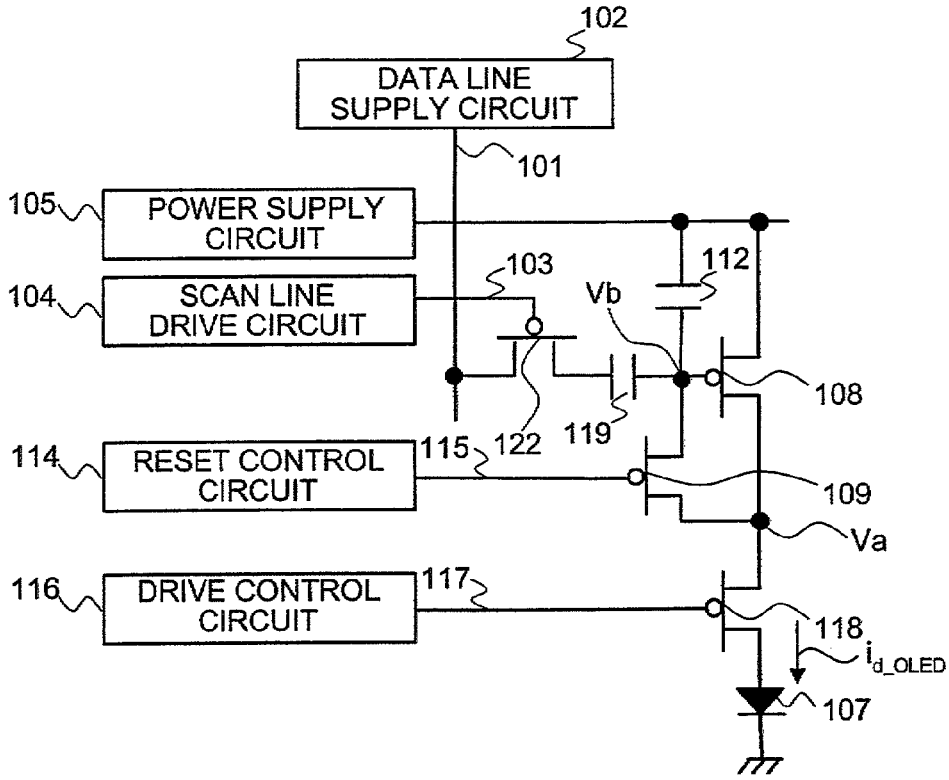
FIG. 15A shows a configuration of a main part (for one pixel) of a conventional image display apparatus.

Referring to FIG. 15A, the light emitting device 107 has a current-voltage characteristic to pass current when a potential difference (potential difference between the anode and cathode) equal to or more than threshold voltage $V_{th,i\text{-}v}$ is generated. Further, the light emitting device 107 has a brightness-voltage characteristic to emit light (brightness >0) when a potential difference (potential difference between the anode and cathode) equal to or more than threshold voltage $V_{th,L\text{-}v}$ is generated as shown in FIG. 16B.

Further, the threshold voltage $V_{th,i\text{-}v}$ is a lower value than the threshold voltage $V_{th,L\text{-}v}$. Accordingly, when the potential difference between the anode and cathode of the light emitting device 107 is equal to or more than the threshold voltage $V_{th,L\text{-}v}$, a current flows through the light emitting device 107 and light is emitted. When the potential difference between the anode and cathode of the light emitting device 107 is equal to or more than the threshold voltage $V_{th,i\text{-}v}$ and less than the threshold voltage $V_{th,L\text{-}v}$, a current flows through the light emitting device 107 but no light is emitted.

In the case of driving the image display apparatus, four steps of resetting, detecting a threshold voltage, writing data, and emitting light are repeatedly performed. As below, the first step of resetting will be described.

Figure 15B:
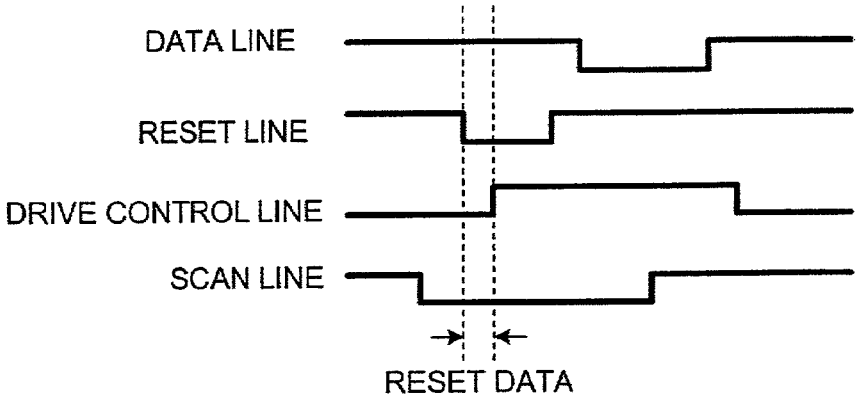
FIG. 15B is a time chart for explanation of the operation of the conventional image display apparatus.

As the first step, the reset step of resetting the potential applied to the gate electrode of the driver device 108 at the time of previous light emission is performed. In the reset step, as shown in FIG. 15B, the data line 101 is set at high-level potential, the reset line 115 is set to low-level potential, the drive control line 117 is set to low-level potential, and the scan line 103 is set to low-level potential.

Here, the potential difference between the anode and cathode of the light emitting device 107 is a Va when the switching device 118 is ON.

Figure 17:
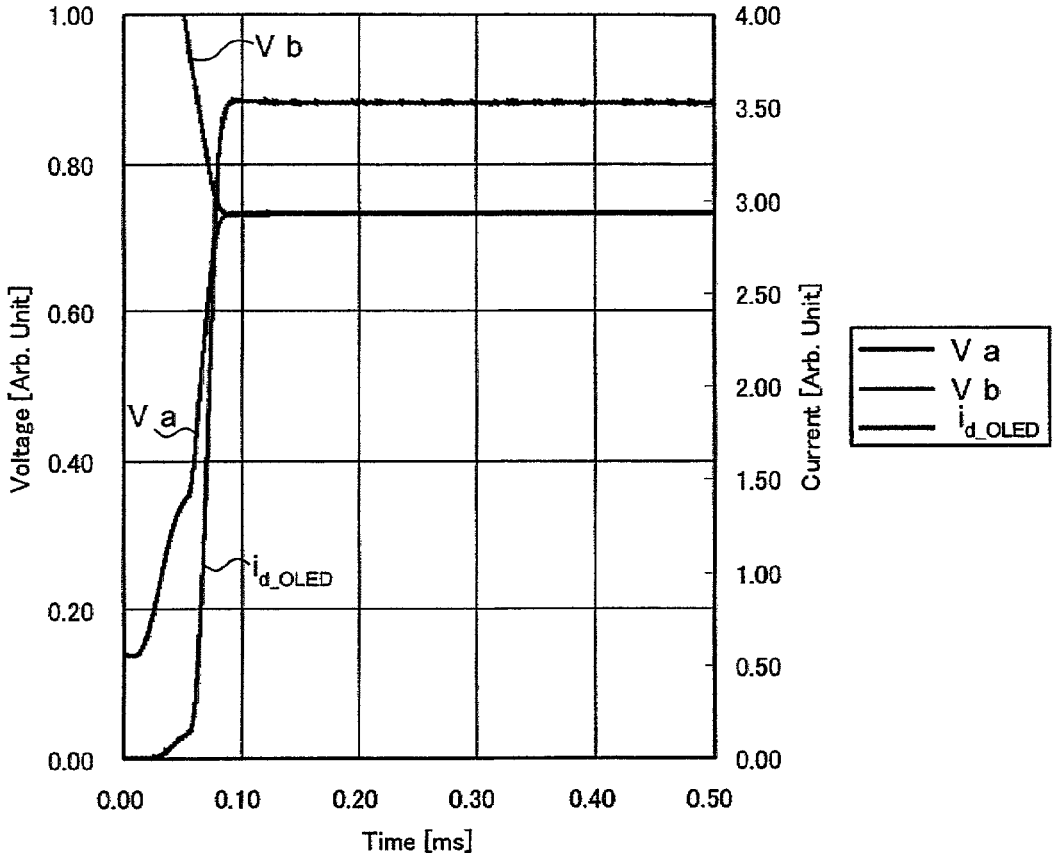

FIG. 17 shows transient response characteristics at the reset step. Specifically, FIG. 17 shows transient response characteristics of potential Va, potential Vb, and current $i_d_O_{LED}$ flowing through the light emitting device 107, which correspond respectively to those in FIG. 15A.

As can be seen from FIG. 17, in the reset step starting at Time=0.00, the potential of the source electrode of the driver device 108 is at high-level potential. As a result, the potential Vb drastically drops, the potential Va rises, and the potential difference between the anode and the cathode of the light emitting device 107 sharply rises to the threshold voltage $V_{th,L\text{-}v}$ shown in FIG. 16B or more. Thereby, the current $i_{d_OLED}$ flows through the light emitting device 107 and light is emitted. The light emission in the reset step is essentially unnecessary as will be described later.

After the reset step, through the above-described steps of detecting a threshold voltage and writing data, the light emitting device 107 emits light in the step of emitting light.

It has been known that the definition becomes lower as the number of thin-film transistors for one pixel circuit becomes larger in the image display apparatus. Therefore, the definition is higher in the two-TFT configuration than in the three-TFT configuration or the four-TFT configuration.

Figure 18A:
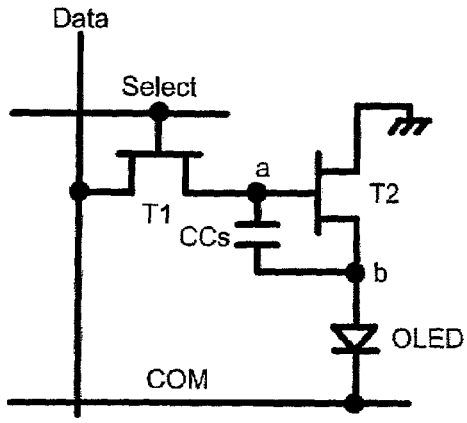
FIG. 18A shows a configuration of a main part (for one pixel) of a conventional image display apparatus having 2TFT configuration.
Figure 18B:
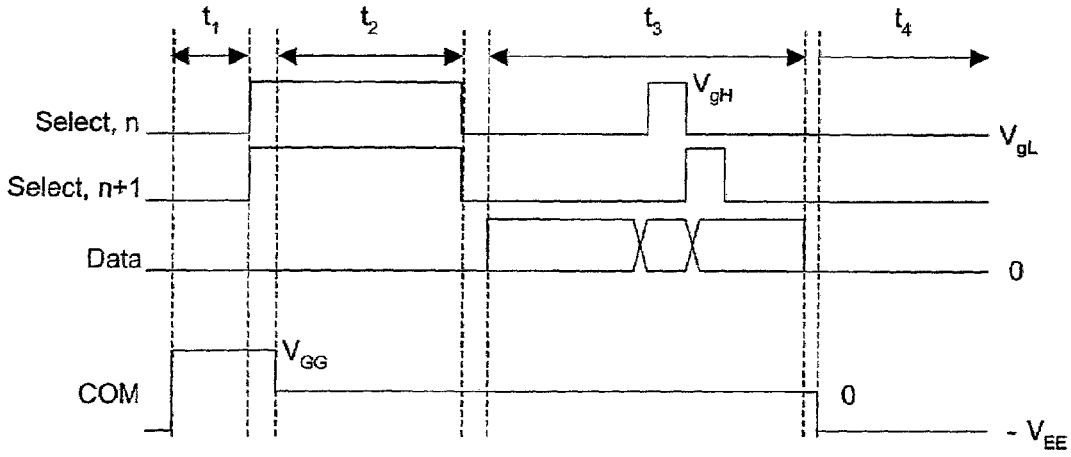
FIG. 18B shows a time chart for explanation of the operation of the conventional image display apparatus having two-TFT configuration.
Figure 19A:
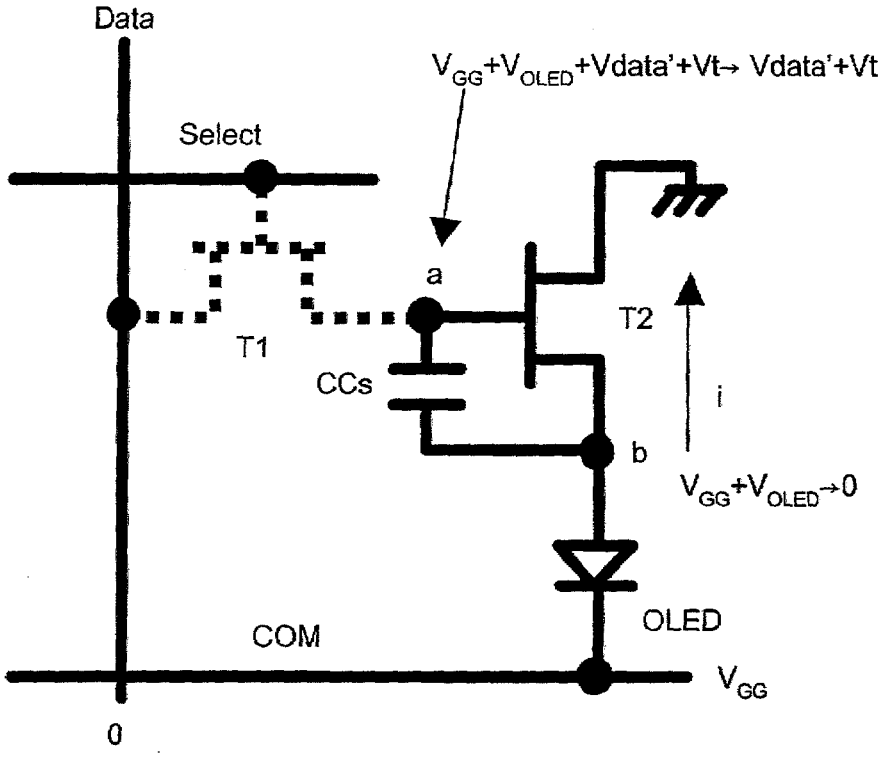
FIG. 19A shows a preparation step of the image display apparatus shown in FIG. 18A.

The period $t_1$ in FIG. 18B is the preparation step. As shown in FIG. 18B and FIG. 19A, when the potential of scan line Select is $V_{gL}$, the potential of data line Data is zero potential, and the potential of common line COM is $V_{GG}$ in the period t1, the switching device T1 is OFF, the driver device T2 is ON, potential "a" of the gate electrode of the driver device T2 is $V_{GG}+V_{OLED}$ (voltage drop of the light emitting device OLED)$+V_{data}'$ (data voltage)$+V_t$ (threshold voltage of the driver device T2), and the potential "b" of the anode of the light emitting device OLED is $V_{GG}+V_{OLED}$. Thereby, current i flows and the potential "a" becomes from $V_{GG}+V_{OLED}+V_{data}'+V_t$ to $V_{data}'+V_t$, and the potential "b" becomes $V_{GG}+V_{OLED}$ to zero potential.

Figure 19B:
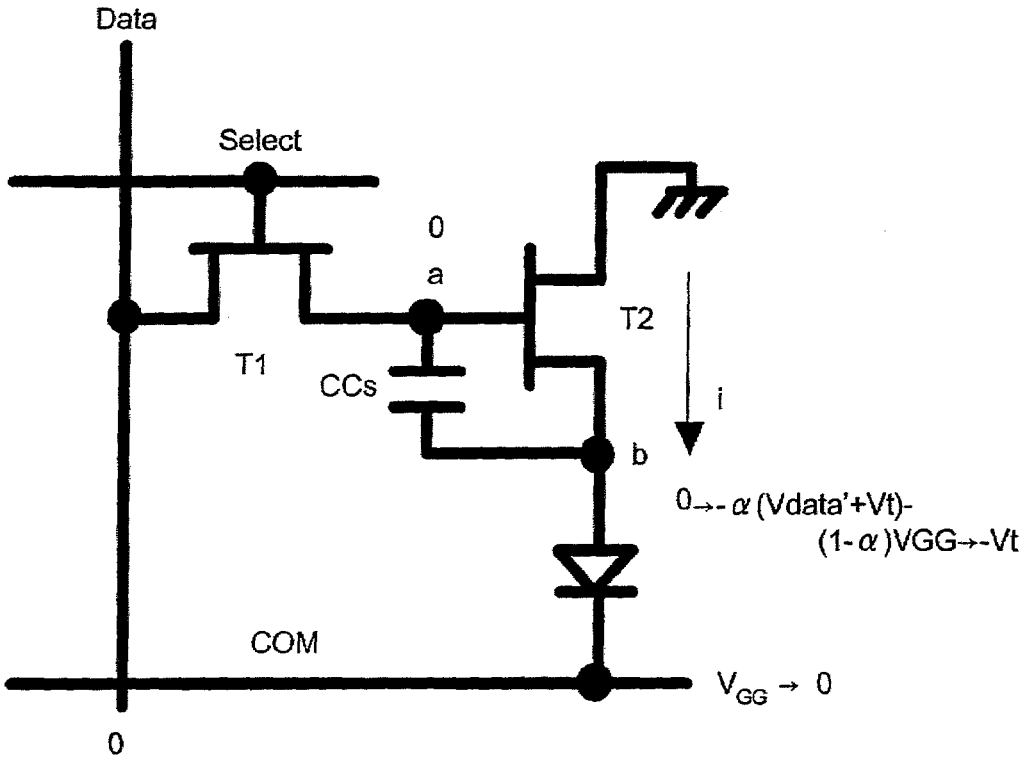
FIG. 19B shows a threshold-voltage detecting step of the image display apparatus shown in FIG. 18A.

The period $t_2$ in FIG. 18B is the threshold-voltage detecting step. As shown by FIG. 18B and FIG. 19B, when the potential of scan line Select is $V_{gH}$, the potential of data line Data is zero potential, and the potential of common line COM is 0 in the period t2, the switching device T1 is ON, the driver device T2 is ON, the potential "a" of the gate electrode of the driver device T2 becomes 0, and the potential "b" becomes from zero potential to $-\alpha(V_{data}'+V_t)-(1-\alpha)V_{GG}$. Then, current i flows and the potential "b" becomes from $-\alpha(V_{data}'+V_t)-(1-\alpha)V_{GG}$ to $-V_t$. Here, $\alpha$ is $CC_s/(C_s+C_{OLED})$. $CC_s$ is a capacitance of the capacitor $CC_s$. $C_{OLED}$ is a capacitance value of the light emitting device OLED.

Figure 19C:
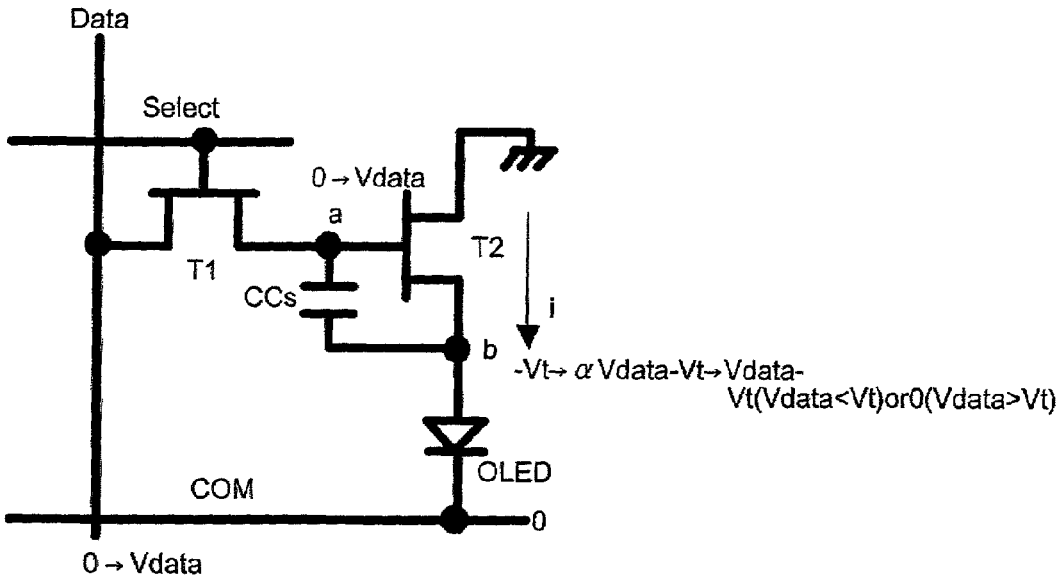
FIG. 19C shows a data-writing step of the image display apparatus shown in FIG. 18A.

The period $t_3$ in FIG. 18B is the data-writing step. As shown by FIG. 18B and FIG. 19C, when the potential of scan line Select is $V_{gH}$, the potential of data line Data is data potential $V_{data}$, and the potential of common line COM is 0 in the period t3, the switching device T1 is ON, the driver device T2 is ON, potential "a" of the gate electrode of the driver device T2 becomes from 0 to $V_{data}$, and the potential "b" becomes from $-V_t$ to $\alpha V_{data}-V_t$. Then, current i flows. Here, the potential "b" becomes from $-V_t$ to $V_{data}-V_t$ when $V_{data}$ is less than $V_t$. On the other hand, the potential "b" becomes zero potential when $V_{data}$ is more than $V_t$.

Figure 19D:
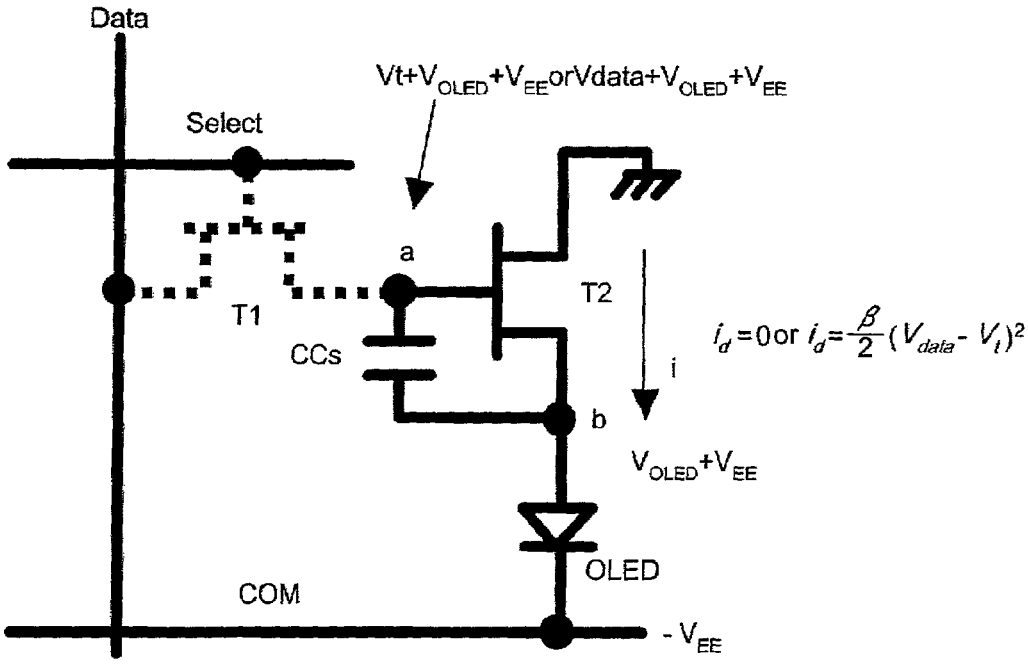

The period $t_4$ in FIG. 18B is the light-emitting step. As shown by FIG. 18B and FIG. 19D, the potential of scan line Select is $V_{gL}$, the potential of data line Data is zero potential, and the potential of common line COM is $-V_{EE}$ in the period t3, the switching device T1 is OFF, the driver device T2 is ON, the potential "a" of the gate electrode of the driver device T2 becomes $V_t+V_{OLED}+V_{EE}$ or $V_{data}+V_{OLED}+V_{EE}$.

Here, when the potential "a" is $V_t+V_{OLED}+V_{EE}$, the potential "b" shown in FIG. 19C corresponds to $V_{data}-V_t$ ($V_{data}<V_t$). In this case, no current $i_d$ (=0) flows through the light emitting device OLED ($i_d$=0). On the other hand, when the potential "a" is $V_{data}+V_{OLED}+V_{EE}$, the potential "b" shown in FIG. 19C corresponds to 0 ($V_{data}>V_t$). In this case, current $i_d$ ($=(\beta/2)(V_{data}-V_t)^2$) flows through the light emitting device OLED. That is, since whether current $i_d$ flows through the light emitting device OLED or not depends on the magnitude correlation between $V_{data}$ and $V_t$, light is emitted or not according to the magnitude correlation. In other words, the light emission condition of the light emitting device OLED depends on the threshold voltage $V_t$ of the driver device T2.

However, in the image display apparatus as proposed in Dawson et al, there has been a problem of reduction in contrast because the potential of the source electrode of the driver device 108 shown in FIG. 15A is at high-level potential and the potential difference between the anode and cathode of the light emitting device 107 becomes equal to or more than the threshold voltage $V_{th,L-v}$ shown in FIG. 16B at the reset step, and thereby, the light emitting device 107 emits light in the reset step resetting the potential applied to the gate electrode of the driver device 108 at the time of previous light emission and forms a white pixel although a black pixel is essentially desired.

Further, in the above-described image display apparatus, the amount of current flowing through the light emitting device in the reset step increases because the driver device is ON in the reset step. Therefore, there has been a problem of further reduction in contrast because the amount of current flowing through the light emitting device in the reset step becomes larger.

In order to improve definition, one having two-TFT configuration described by referring to FIGS. 18B and 19A to 19D has been proposed as a conventional image display apparatus. However, as described by referring to FIGS. 19C and 19D, there are cases where current $i_d$ flows or does not flow through the light emitting device OLED depending on the magnitude correlation between $V_{data}$ and $V_t$, the light emission condition of the light emitting device OLED becomes unstable. That is, such an image display apparatus having two-TFT configuration is not applied to practical use.

Embodiments of an image display apparatus according to the present invention will be described in detail below with reference to the drawings. Note that the invention is not limited by the embodiments.

Figure 1:
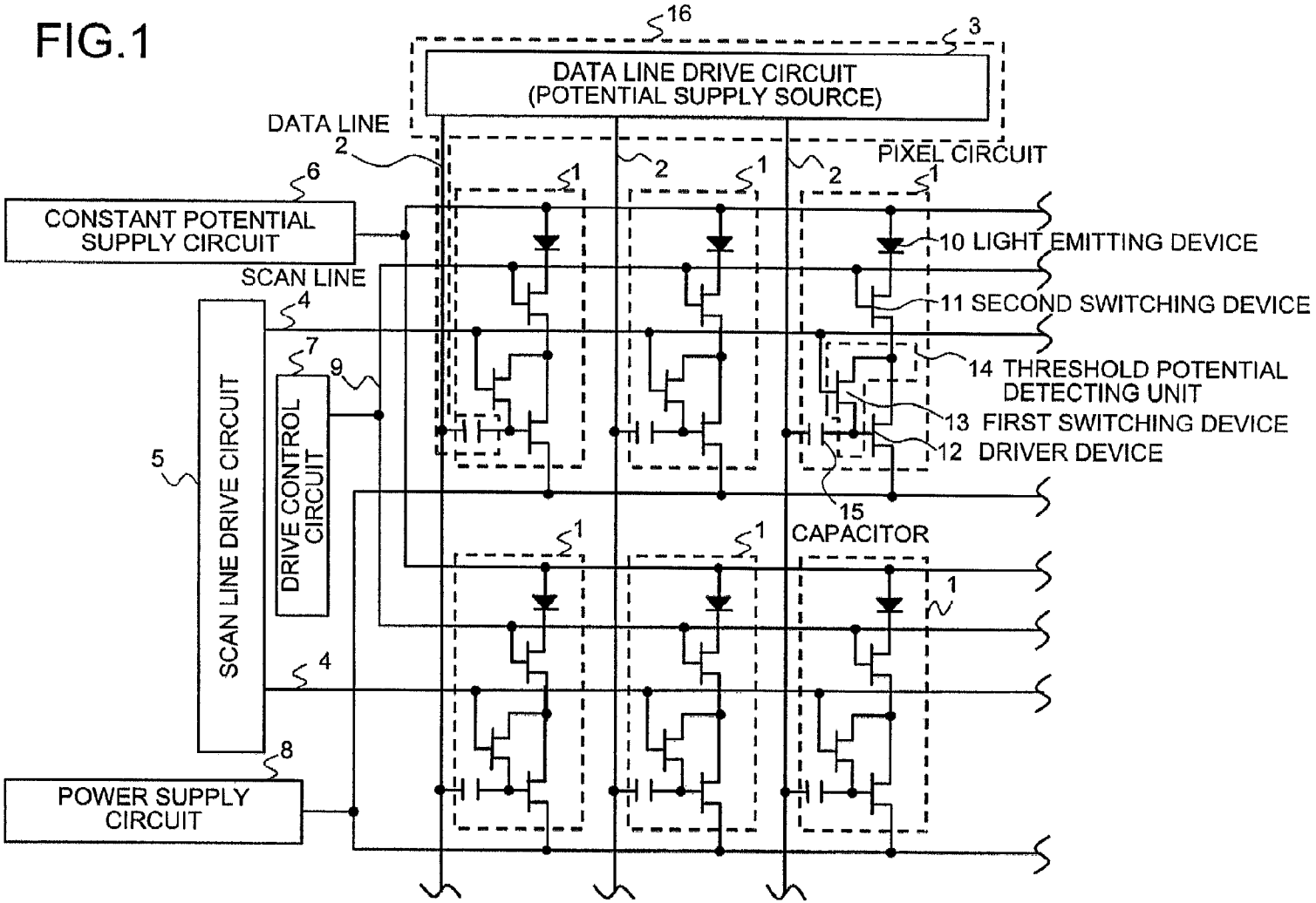
FIG. 1 shows an overall configuration of an image display apparatus according to a first embodiment of the invention.

FIG. 1 shows an overall configuration of an image display apparatus according to a first embodiment of the invention. The image display apparatus shown in FIG. 1 has a function of effectively preventing light emission in a reset step for improving contrast. The image display apparatus includes plural pixel circuits 1 arranged in a matrix form, a data line drive circuit 3 for supplying brightness signals to the plural pixel circuits 1 via plural data lines 2, and a scan line drive circuit 5 for supplying scan signals to the pixel circuits 1 via plural scan lines 4. The scan signals are signals for selecting pixel circuits 1 to which brightness signals is to be supplied.

Further, the image display apparatus includes a constant potential supply circuit 6 for supplying constant ON potential to the anode of a light emitting device 10, a drive control circuit 7 for controlling the drive of a second switching device 11 via a control line 9, and a power supply circuit 8 for supplying ON potential in the reset step and zero potential at other steps to the source electrode of the driver device 12.

The pixel circuit 1 includes the light emitting device 10 with an anode electrically connected to the constant potential supply circuit 6, the second switching device 11 with one electrode connected to a cathode of the light emitting device 10, a driver device 12 formed of an n-type thin-film transistor with a gate electrode connected to the one electrode of a first switching device 13, a drain electrode connected to the other electrode of the first switching device 13 and a source electrode electrically connected to the power supply circuit 8, and a threshold potential detecting unit 14 comprising the first switching device 13 that controls the conduction state between the gate and drain of the thin-film transistor forming the driver device 12.

The light emitting device 10 has a mechanism of emitting light due to current injection and forms of an organic EL device, for example. The organic EL device has a structure including at least an anode layer and a cathode layer made of Al, Cu or ITO (Indium Tin Oxide), etc., and an emission layer made of an organic material such as phthalocyanine complex, trisaluminum complex, benzoquinolinolato complex, and/or beryllium complex, and has a function of generating light by emission due to recombination of holes and electrons injected in the emission layer.

The second switching device 11 has a function of controlling the conduction between the light emitting device 10 and the driver device 12 and comprises an n-type thin-film transistor in the first embodiment. Specifically, the device has a structure that the drain electrode and the source electrode of the thin-film transistor are connected to the light emitting device 10 and the driver device 12 respectively, and the gate electrode is electrically connected to the drive control circuit 7. The second switching device 11 controls the conduction state between the light emitting device 10 and the driver device 12 based on the potential supplied from the drive control circuit 7.

The driver device 12 has a function of controlling current flowing through the light emitting device 10. Specifically, the driver device 12 has a function of controlling current flowing through the light emitting device 10 according to the potential difference equal to or more than the drive threshold value applied between a first terminal and a second terminal. In the first embodiment, the driver device 12 comprises an n-type thin-film transistor and controls the emission brightness of the light emitting device 10 according to the potential difference applied between the gate electrode corresponding to the first terminal and the source electrode corresponding to the second terminal.

A capacitor 15 forms a brightness potential/reference potential supply unit 16 by combination with the data line drive circuit 3. The brightness potential/reference potential supply unit 16 has a function as a brightness potential supply unit of detecting the potential difference corresponding to the drive threshold value of the driver device 12 (hereinafter, referred to as "threshold voltage") and supplying a reference potential.

The threshold potential detecting unit 14 is for detecting the threshold voltage of the driver device 12. In the first embodiment, the threshold potential detecting unit 14 comprises the first switching device 13 as an n-type thin-film transistor. Specifically, the first switching device 13 has a structure in which one of source and drain electrodes of the thin-film transistor is connected to the drain electrode of the driver device 12, the other of source and drain electrodes is connected to the gate electrode of the driver device 12, and the gate electrode of the first switching device 13 is electrically connected to the scan line drive circuit 5. Accordingly, the threshold potential detecting unit 14 has a function of electrically connecting the gate and drain electrodes of the driver device 12 based on the potential supplied from the scan line drive circuit 5, and has a function of detecting the threshold voltage of the driver device 12 by shifting the potential difference between the gate and source electrodes to about the threshold voltage of the driver device 12 while the gate and drain of the driver device 12 is electrically connected.

Figure 2:
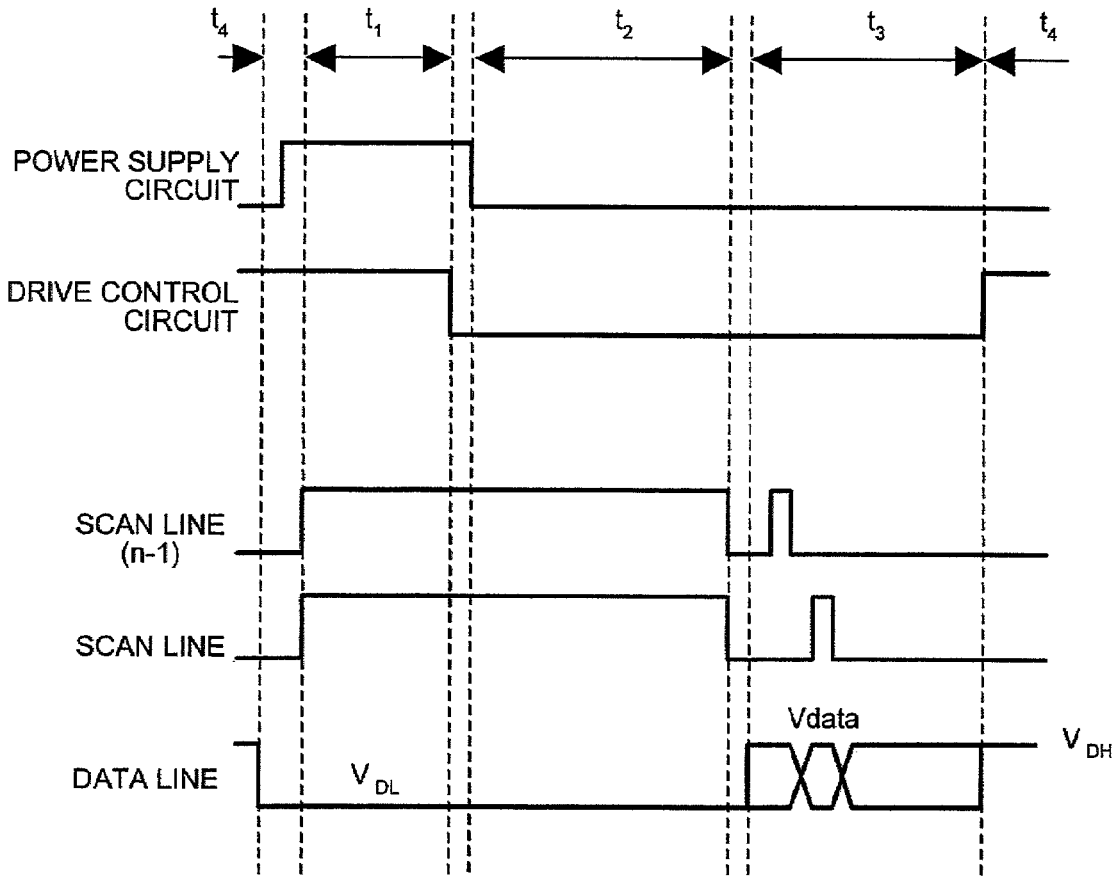
FIG. 2 is a time chart showing modes of potential variations of respective component elements for explanation of the operation of the image display apparatus according to the first embodiment.

FIG. 2 is a time chart showing modes of potential variations of the respective component elements of the image display apparatus according to the first embodiment. In FIG. 2, scan line (n−1) located in the row previous to scan line (n) is shown for reference. FIGS. 3A to 3D show conditions of the pixel circuit 1 corresponding to the periods $t_1$ to $t_4$ shown in FIG. 2.

First, the reset step of resetting the potential applied to the gate electrode of the driver device 12 at the time of previous light emission is performed. Specifically, as shown by period $t_1$ in FIG. 2 and FIG. 3A, potentials of the power supply circuit 8, the drive control circuit 7, and the scan line 4 (scan line drive circuit 5) change to ON potentials. The potential of the constant potential supply circuit 6 is constantly set to a constant ON potential. The potential of the data line 2 is set to $V_{DL}$.

Figure 3A:
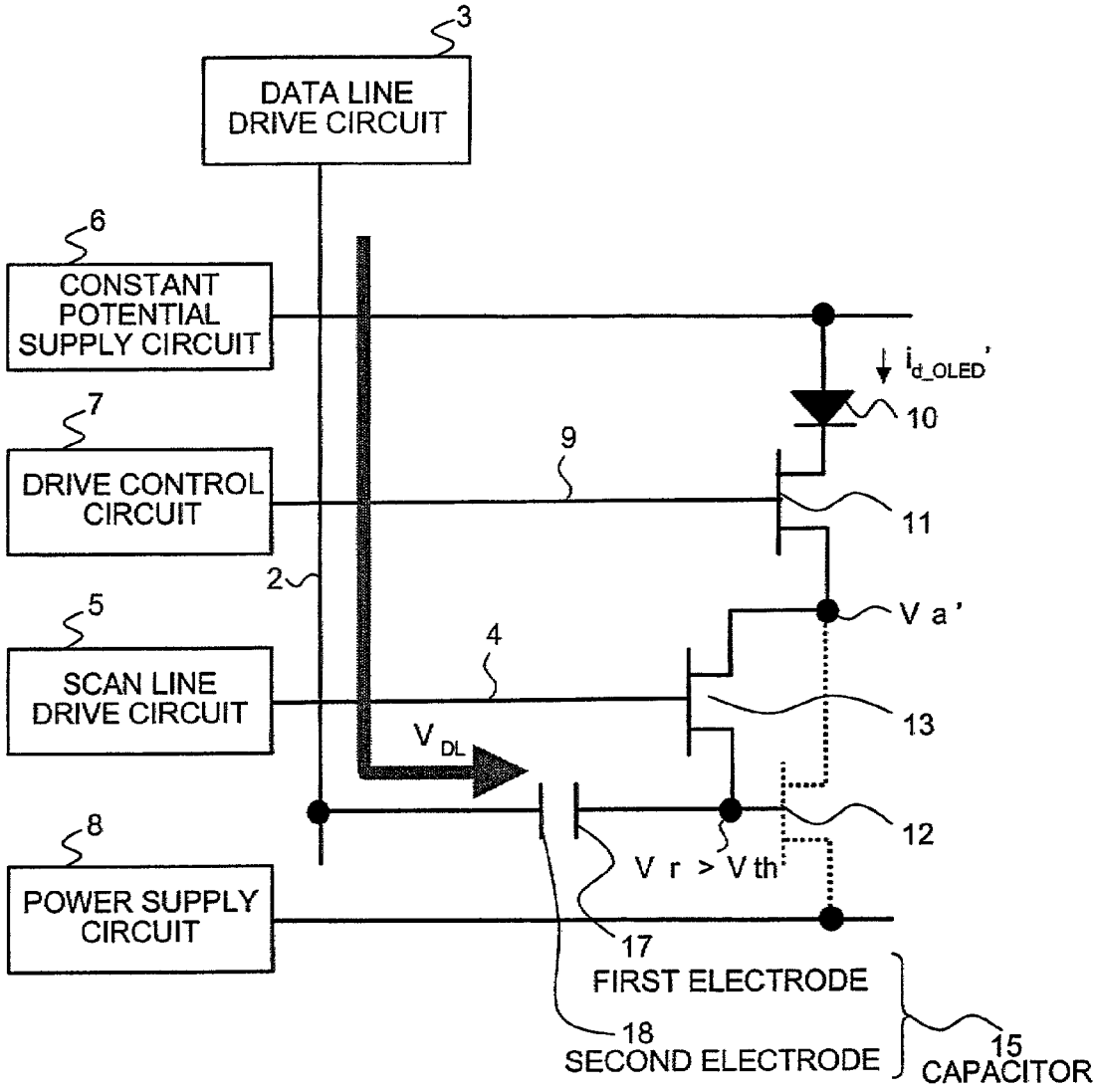
FIG. 3A shows a reset step of the image display apparatus according to the first embodiment.

That is, as shown in FIG. 3A, the second switching device 11 and the first switching device 13 are ON. On the other hand, the driver device 12 is OFF because the potential of the power supply circuit 8 is ON potential. Accordingly, the potential of a first electrode 17 of the capacitor 15 takes a value obtained by subtracting the potential drop within the light emitting device 10 from the potential supplied from the constant potential supply circuit 6 to the anode side of the light emitting device 10. Since the ON potential supplied from the constant potential supply circuit 6 generally has a sufficiently high value, the potential of the first electrode 17 of the capacitor 15 (i.e., the potential of the gate electrode of the driver device 12) is held at $V_r$ having a higher value than the threshold voltage $V_{th}$.

Meanwhile, since the potential of the data line 2 is $V_{DL}$ as shown in FIG. 2, the potential of a second electrode 18 of the capacitor 15 becomes $V_{DL}$. Accordingly, in the step shown by period $t_1$ in FIG. 2 and FIG. 3A, the potential of $V_r$ ($>V_{th}$) is supplied to the first electrode 17 of the capacitor 15, and the potential $V_{DL}$ is supplied to the second electrode 18 of the capacitor 15.

Figure 4:
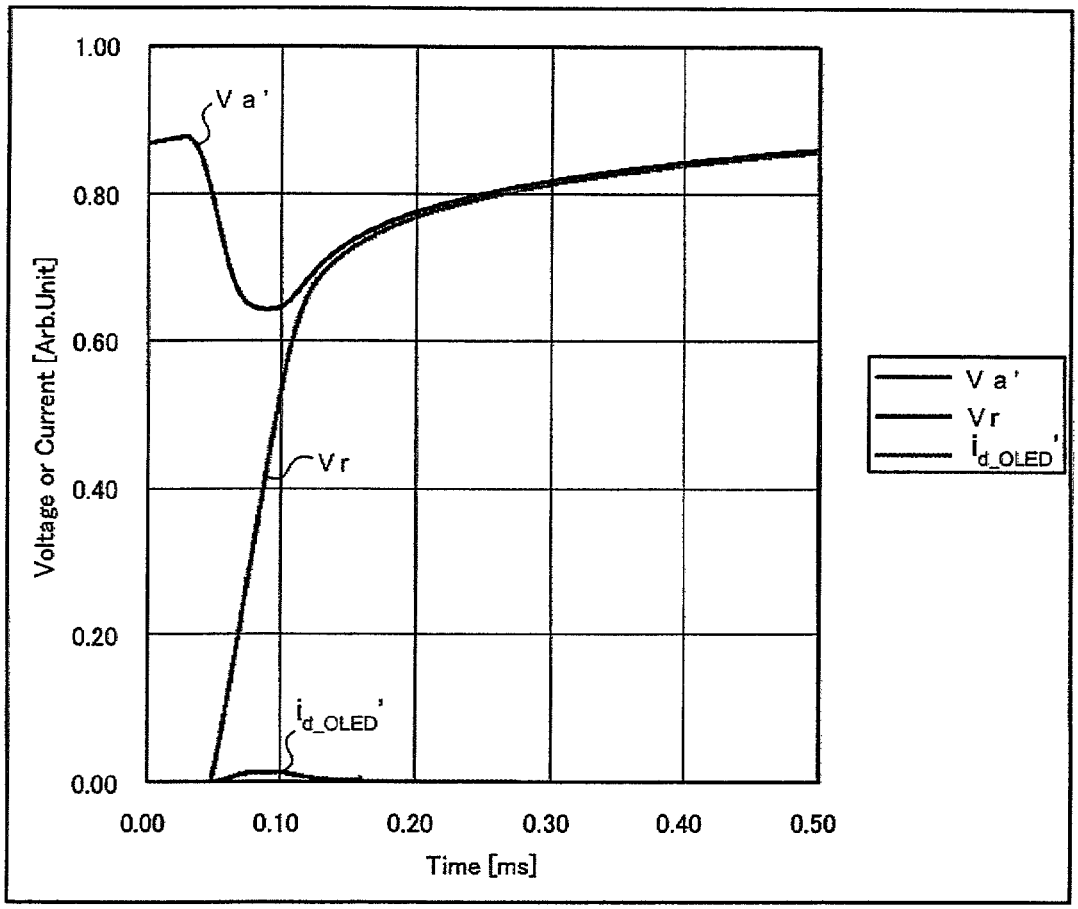

FIG. 4 shows transient response characteristics after the first switching device 13 shown in FIG. 3A is turned ON (the driver device 12 is turned OFF). That is, the same drawing shows the transient response characteristics of the potential Va' of the cathode of the light emitting device 10, the potential $V_t$ ($>V_{th}$) of the gate electrode (the first electrode 17) of the driver device 12, and current $i_{d_OLED}$' flowing through the light emitting device 10.

As can be seen from the drawing, after the first switching device 13 is turned ON (the driver device 12 is turned OFF) at Time=0.00, the potential $V_r$ increases and the potential Va' decreases in a short time and then increases.

Figure 14A:
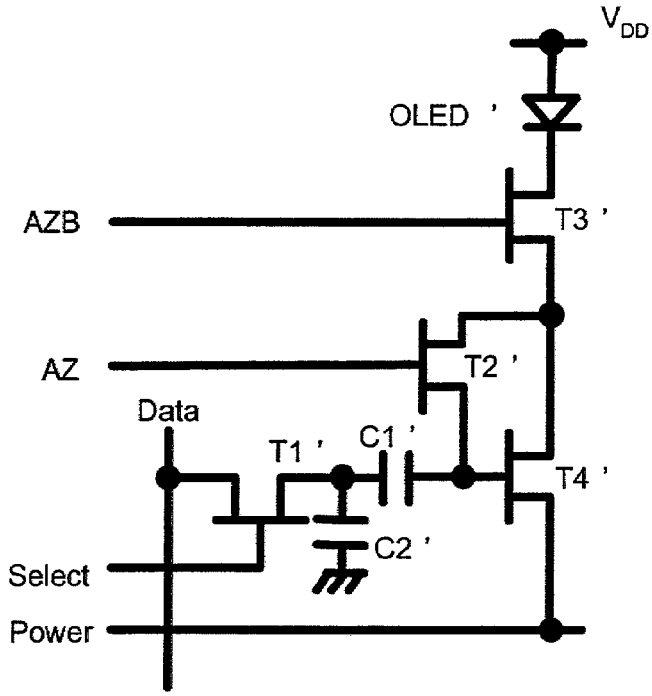
FIG. 14A shows a configuration of a main part of an image display apparatus according to a fifth embodiment.
Figure 14B:
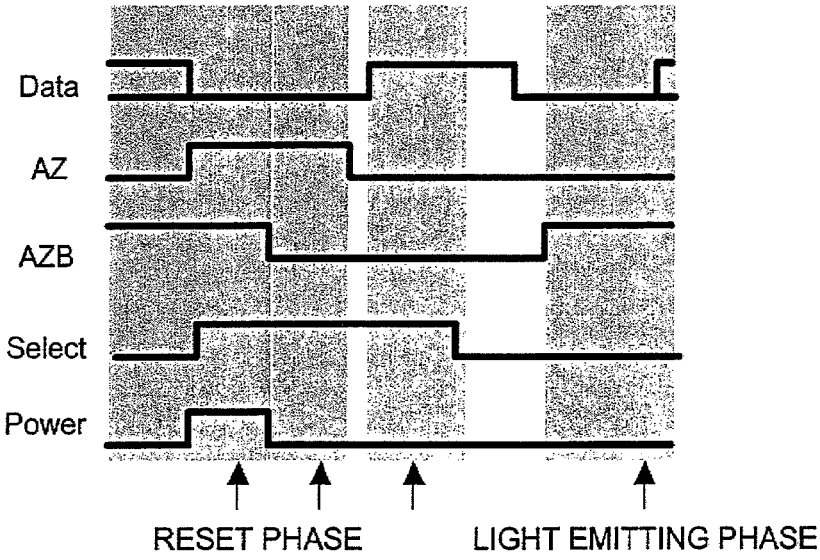
FIG. 14B is a time chart for explanation of the operation of the image display apparatus according to the fifth embodiment.

Here, in the first embodiment, parameters $C_s$ and $C_{OLED}$ in the following expression (1) are set so that the potential difference between the anode and cathode of the light emitting device 10 (the difference between the ON potential from the constant potential supply circuit 6 and the potential Va') when the potential Va' decreases in a short time becomes equal to or more than the above-described threshold voltage $V_{th,i\text{-}v}$ (FIG. 14A) and less than the threshold voltage $V_{th,L\text{-}v}$ (FIG. 14B). The parameter $C_s$ is a capacitance of the capacitor 15. The parameter $C_{OLED}$ is a capacitance component of the light emitting device 10.

$$V_{th,L\text{-}v} > (C_s/(C_s+C_{OLED}))\cdot V_{th,i\text{-}v} \quad (1)$$

Accordingly, in the first embodiment, the slight current $i_{d_OLED}$' flows as shown in FIG. 4 but with no light emission because the potential difference between the anode and cathode of the light emitting device 10 is equal to or more than the threshold value $V_{th,i\text{-}v}$ (FIG. 14A) and less than the threshold value $V_{th,L\text{-}v}$ in the reset step.

Figure 3B:
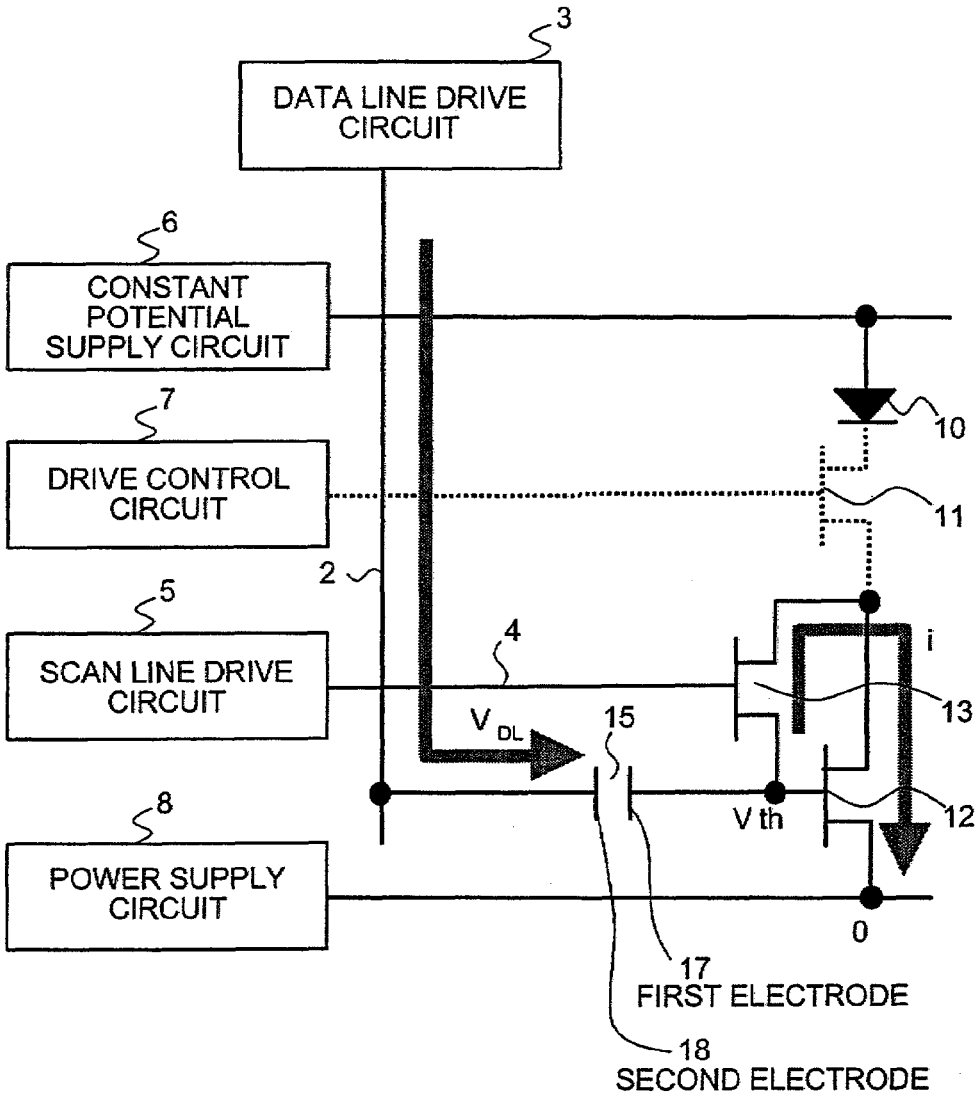
FIG. 3B shows a threshold-voltage detecting step of the image display apparatus according to the first embodiment 1.

Next, as shown by period $t_2$ in FIG. 2 and FIG. 3B, the potential of the power supply circuit 8 is set from ON potential to zero potential. Further, the potential of the drive control circuit 7 is set from ON potential to OFF potential, and the second switching device 11 is turned OFF. Furthermore, the potential of the scan line 4 is kept at ON potential and the first switching device 13 is kept ON. Moreover, the potential of the data line 2 is kept at zero potential.

First, the change in the potential of the drive control circuit 7 will be described. Since the first switching device 13 changes into ON as described above, the gate electrode and the drain electrode of the driver device 12 are electrically connected. Meanwhile, as described above, $V_r$ having a higher value than the threshold voltage $V_{th}$ is kept at the gate electrode of the driver device 12 in the period t1. Since the zero potential is supplied to the source electrode by the power supply circuit 8 in the period t2, the potential difference between the gate and source electrodes of the driver device 12 becomes $V_r$ and the driver device 12 is ON.

Accordingly, regarding the driver device 12, the gate and source electrodes are electrically connected via the first switching device 13, and current i flows from the gate electrode to the source electrode based on the charge held at the gate electrode. Since such current i flows until the driver device 12 turns OFF, finally, the potential difference between the gate and source electrodes of the driver device 12 substantially becomes equal to the threshold voltage $V_{th}$ and the source electrode keeps zero potential, and thereby, the potential of the gate electrode of the driver device 12, i.e., the potential of the first electrode 17 of the capacitor 15 becomes $V_{th}$. Meanwhile, the potential of the second electrode 18 of the capacitor 15 is set to $V_{DL}$ supplied via the data line 2. The period $t_2$ is desirably provided when a device having low mobility such as a thin-film transistor of amorphous silicon, for example, is utilized as the driver device, and a device having high mobility like polysilicon can be operated without providing the period $t_2$.

Figure 3C:
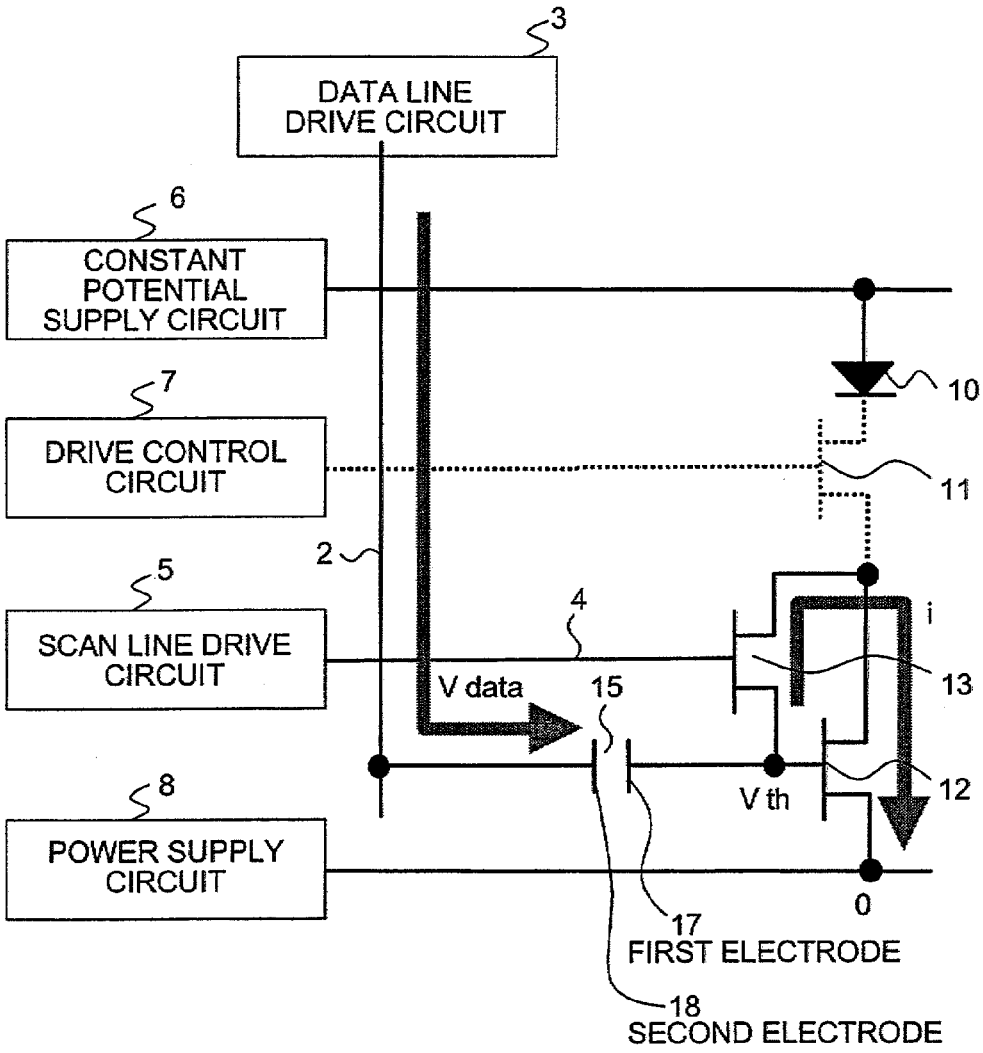
FIG. 3C shows a data-writing step of the image display apparatus according to the first embodiment.
Figure 3D:
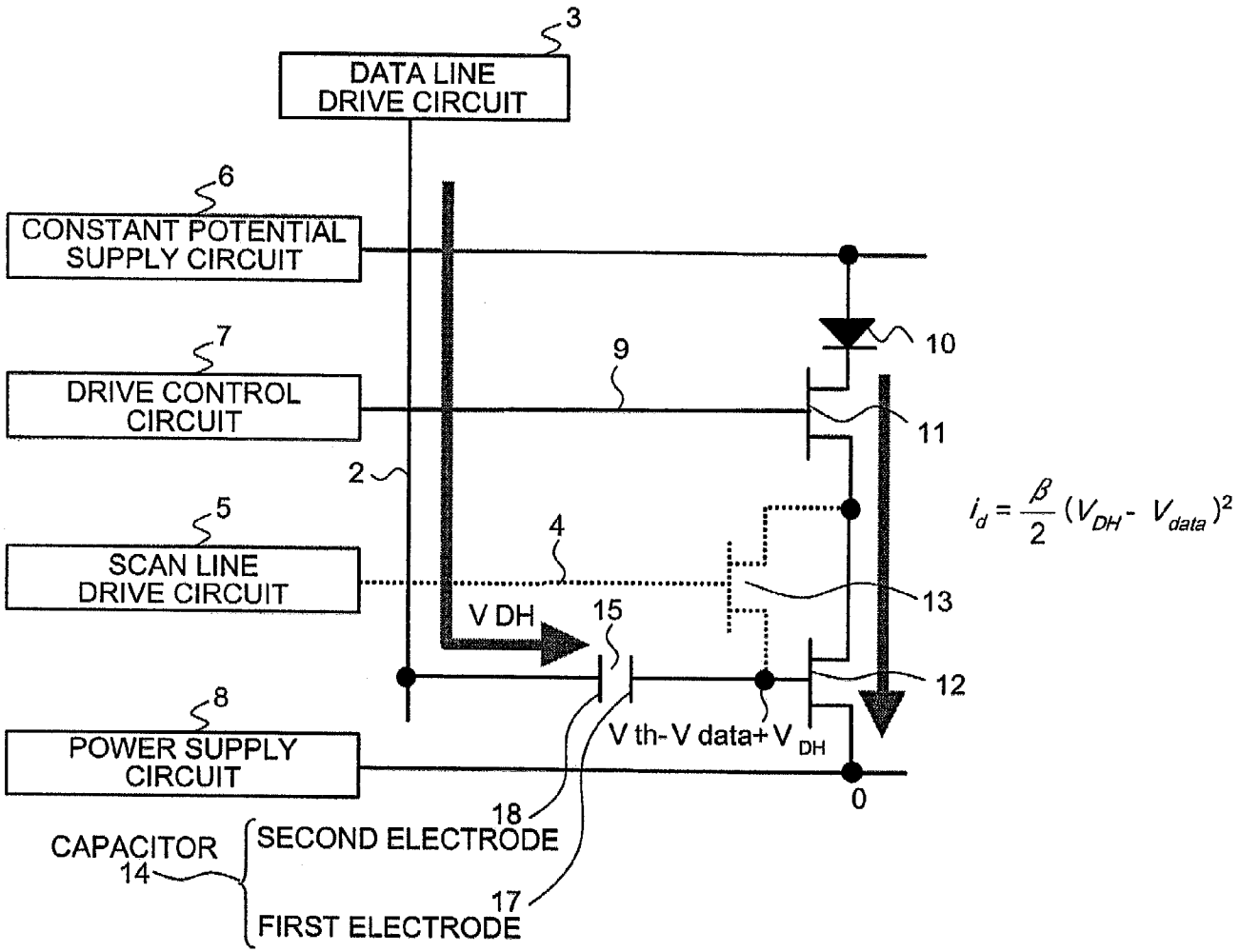
FIG. 3D shows a light-emitting step of the image display apparatus according to the first embodiment.

Next, as shown by period $t_3$ in FIG. 2 and FIG. 3C, brightness potential $V_{data}$ is supplied from the data line drive circuit 3 via the data line 2. At this time, the potential of the gate electrode of the driver device 12 becomes higher than $V_{th}$ again, and current flows via the first switching device 13 and the driver device 12, and then, the potential of the gate electrode of the driver device 12 becomes $V_{th}$ again. Finally, the data line drive circuit 3 via the data line 2, and thereby, the potential of the first electrode 17 as shown by period $t_4$ in FIG. 2 and FIG. 3D, in the light-emitting step, the reference potential $V_{DH}$ is supplied from of the capacitor 15 is $V_{th}-V_{data}+V_{DH}$, current $i_d$ $(=(\beta/2)(V_{DH}-V_{data})^2)$ flows through the light emitting device 10, and the light emitting device 10 emits light. β is a value in proportion to mobility of the carrier of the driver device 12 and a value specific to the driver device 12 of the pixel.

As described above, according to the first embodiment, in the reset step of resetting the potential applied to the first terminal (gate electrode) of the driver device 12 at the time of previous emission, since the potential difference such that the light emitting device 10 passes current and emits no light is applied to the light emitting device 10, the contrast of the image display device can be improved.

Figure 5:
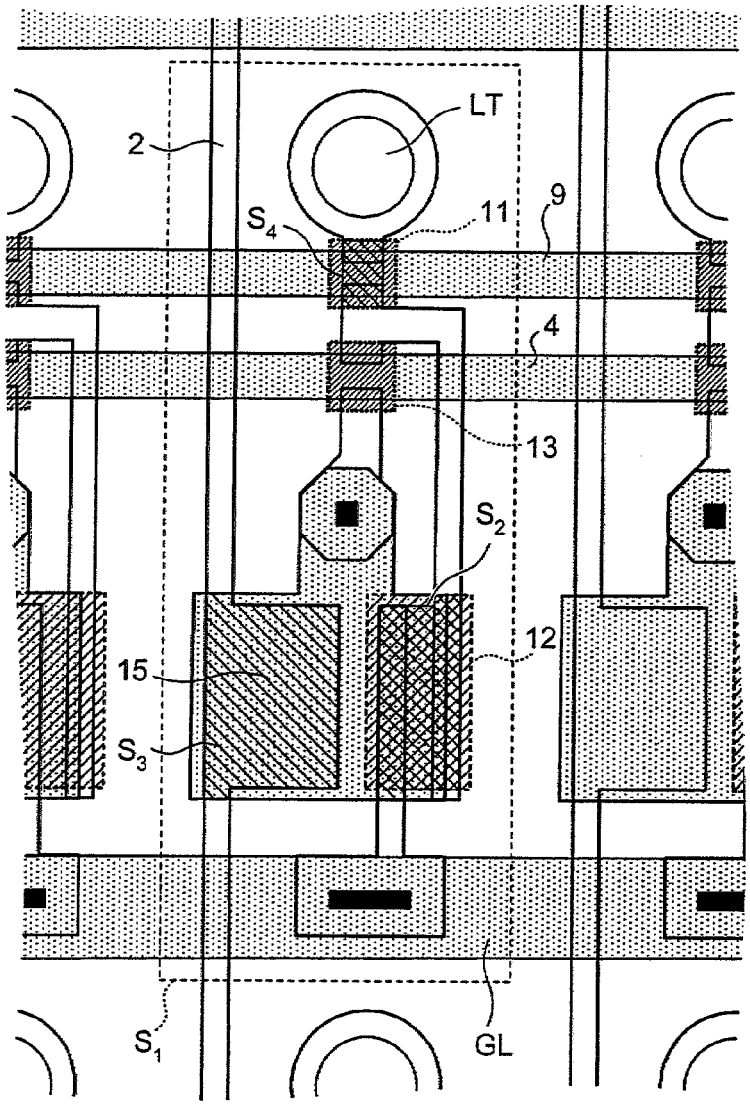
FIG. 5 is an enlarged plan view of the image display apparatus in FIG. 1.

FIG. 5 is an enlarged plan view of the image display apparatus of the first embodiment. Especially, FIG. 5 shows the layout of the layers below a lower electrode (not shown) of the light emitting device 10. Three TFTs (the driver device 12, the first switching device 13, and the second switching device 11) and the capacitor 15 are shown within one pixel. The driver device 12 is located away from the capacitor 15 so that they do not overlap in a plane view. The driver device 12 and the capacitor 15 are located on substantially the same plane. The layers forming each device are a lower electrode layer (an area filled with a dot pattern in the drawing), an insulating layer (an area other than the portions filled with black in the drawing), an active layer (a shaded area in the drawing), and an upper electrode layer (a white area surrounded by a solid line) from the bottom layer. One end of the light emitting device 10 is connected to the terminal LT in the drawing.

The lower electrode layer is formed on a substrate and includes the gate electrode of the driver device 12, the gate electrode (scan line 4) of the first switching device 13, the gate electrode (control line 9) of the second switching device 11, a power supply line GL connected to the power supply circuit 8, and the first electrode 17 of the capacitor 15. The insulating layer is formed on the entire surface of the lower electrode layer within the one pixel except two opening portions (the portions filled with black in the drawing). The insulating layer functions as a gate insulating film for the three TFTs and as a dielectric layer for the capacitor 15. The active layer is formed on the insulating layer and includes active layers of the three TFTs. The upper electrode layer is formed on the active layer and includes source and drain electrodes of the three TFTs, the second electrode 18 of the capacitor 15, and the data line 2.

Further, one of the opening portions in insulating layer is for connecting the power supply line GL and the source electrode of the driver device 12. The other of the opening portions is for connecting the first electrode 17 of the capacitor 15, the gate electrode of the driver device 12, and the drain electrode of the first switching device 13. That is, the upper and lower electrode layers are electrically connected through these opening portions.

As the constituent materials of the respective layers, aluminum or an alloy thereof or the like may be used for the lower electrode layer and the upper electrode layer, a silicon nitride film, silicon oxide film, or a mixture of those or the like may be used for the insulating layer, and amorphous silicon, polycrystalline silicon, or the like may be used for the active layer.

As can be seen from the FIG. 5, in the first embodiment, since the compensation of the threshold voltage $V_{th}$ can be realized using three TFTs, there is room for the layout of one pixel and the areas of the driver device 12 and the capacitor 15 are made larger by utilizing the room. Accordingly, the power consumption of the image display apparatus can be decreased by reducing the resistance of the driver device 12. When the driver device 12 comprises an amorphous silicon transistor having large resistance, the effect is especially great. Further, according to the first embodiment, even when the size for one pixel is as minuscule as 7000 $\mu m^2$ to 50000 $\mu m^2$, the capacitance of the capacitor 15 can be easily assured in appropriate magnitude.

The ratio $(S_2/S_1)$ of area $S_2$ occupied by the driver device 12 per one pixel to area $S_1$ for the one pixel and/or the ratio $(S_3/S_1)$ of area $S_3$ occupied by the capacitor 15 per one pixel to area $S_1$ for the one pixel is equal to or more than 0.05 (preferably equal to or more than 0.07, more preferably equal to or more than 0.1). In the first embodiment, in the size 51 μm×153 μm for one pixel, $S_2/S_1$ of about 0.1 and $S_3/S_1$ of about 0.12 are ensured.

Further, $S_2/S_1$ and $S_3/S_1$ are preferably equal to or less than 0.25. This is because, if $S_2$ and $S_3$ are too large, the area that other circuits can occupy becomes smaller and the circuit layout becomes complicated.

Furthermore, since higher current flows through the driver device 12 than in the first and second switching devices 13 and 11, the ratio $(S_2/S_4)$ of area $S_2$ of the driver device to area $S_4$ of the first and second switching devices 13 and 11 is desirably set to 2 to 10 (more preferably 5 to 10).

The area $S_1$ refers to an area surrounded by a boundary line that divides each pixel in an equal area. Further, the area $S_2$ refers to summation of a source electrode area of the driver 12, a drain electrode area thereof, and an active layer area which refers to the active layer located between the source electrode and drain electrode. The source electrode area and drain electrode area refer to a region in contact with the active layer of electrode layers that form these electrodes. Furthermore, the area $S_3$ refers to an area of a region in which the first electrode 17 and the second electrode 18 of the capacitor 15 are opposed. Moreover, the area $S_4$ refers to summation of the source electrodes area and drain electrodes area of the respective switching devices 13 and 11 and the active layer area between the source electrodes and drain electrodes.

In the above-described the first embodiment, as shown in FIG. 1, the example in which the function of preventing light emission is applied in the reset step of the three-TFT configuration having three thin-film transistors (the second switching device 11, the driver device 12, and the first switching device 13) in the pixel circuit 1 are described above, however, a function according to two-TFT configuration having two thin-film transistors in one pixel circuit may be applied. As below, such example will be described as a second embodiment.

Figure 6:
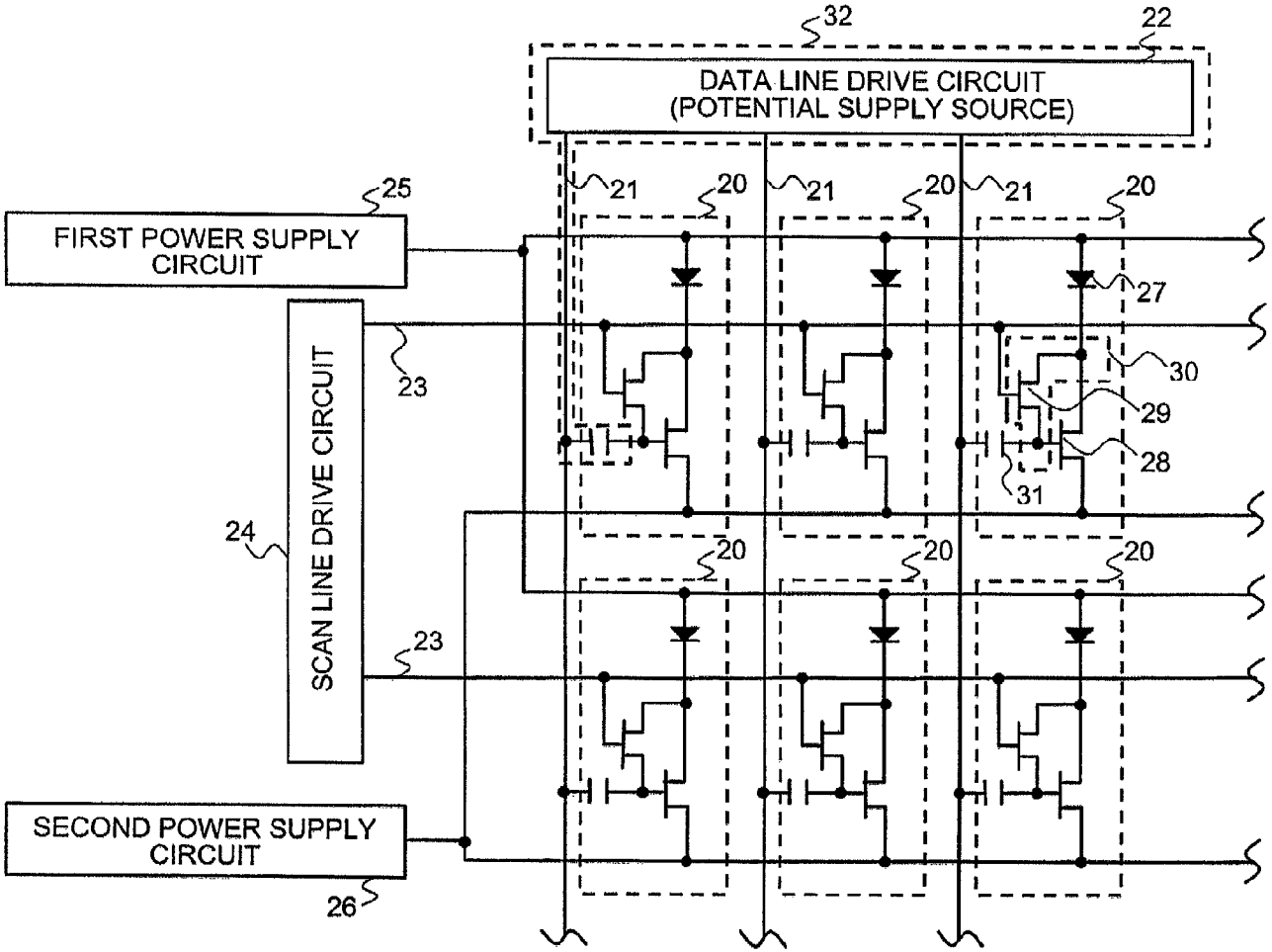
FIG. 6 shows an overall configuration of an image display apparatus according to a second embodiment of the invention.

FIG. 6 shows an overall configuration of an image display apparatus according to the second embodiment of the invention. The image display apparatus shown in FIG. 6 includes plural pixel circuits 20 having a function of preventing light emission in a reset step for improving contrast and arranged in a matrix form, a data line drive circuit 22 for supplying brightness signals, which will be described later, to the plural pixel circuits 20 via plural data lines 21, and a scan line drive circuit 24 for supplying scan signals to the pixel circuits 20 via plural scan lines 23. The scan signals is signals for selection of pixel circuits 20 which brightness signals is to be supplied. The image display apparatus has two-TFT configuration.

Further, the image display apparatus includes a first power supply circuit 25 for supplying ON potential at the time of resetting to the anode of a light emitting device 27 and a second power supply circuit 26 for supplying ON potential at the reset step and zero potential or negative potential at other steps to the source electrode of a driver device 28.

The pixel circuit 20 includes the light emitting device 27 with the anode side electrically connected to the first power supply circuit 25, the driver device 28 with a source electrode electrically connected to the second power supply circuit 26, and a threshold potential detecting unit 30 comprising a switching device 29 that controls the conduction state between the gate and drain of the thin-film transistor forming the driver device 28.

The light emitting device 27 has a mechanism of emitting light by current injection and consists of an organic EL device, for example. The driver device 28 has a function of controlling current flowing in the light emitting device 27. Specifically, the driver device 28 has a function of controlling current flowing through the light emitting device 27 according to the potential difference equal to or more than the drive threshold value applied between a first terminal and a second terminal, and a function of keeping the current flow through the light emitting device 27 during application of the potential difference. In the second embodiment, the driver device 28 consists of an n-type thin-film transistor and controls the light emitting device 27 according to the potential difference applied between the gate electrode corresponding to the first terminal and the source electrode corresponding to the second terminal.

A capacitor 31 forms a brightness potential/reference potential supply unit 3B by combination with the data line drive circuit 22. The brightness potential/reference potential supply unit 3B has a function as a brightness potential supply unit of supplying emission brightness voltage corresponding to the brightness of the light emitting device 27 and a function of supplying a reference potential.

Figure 7:
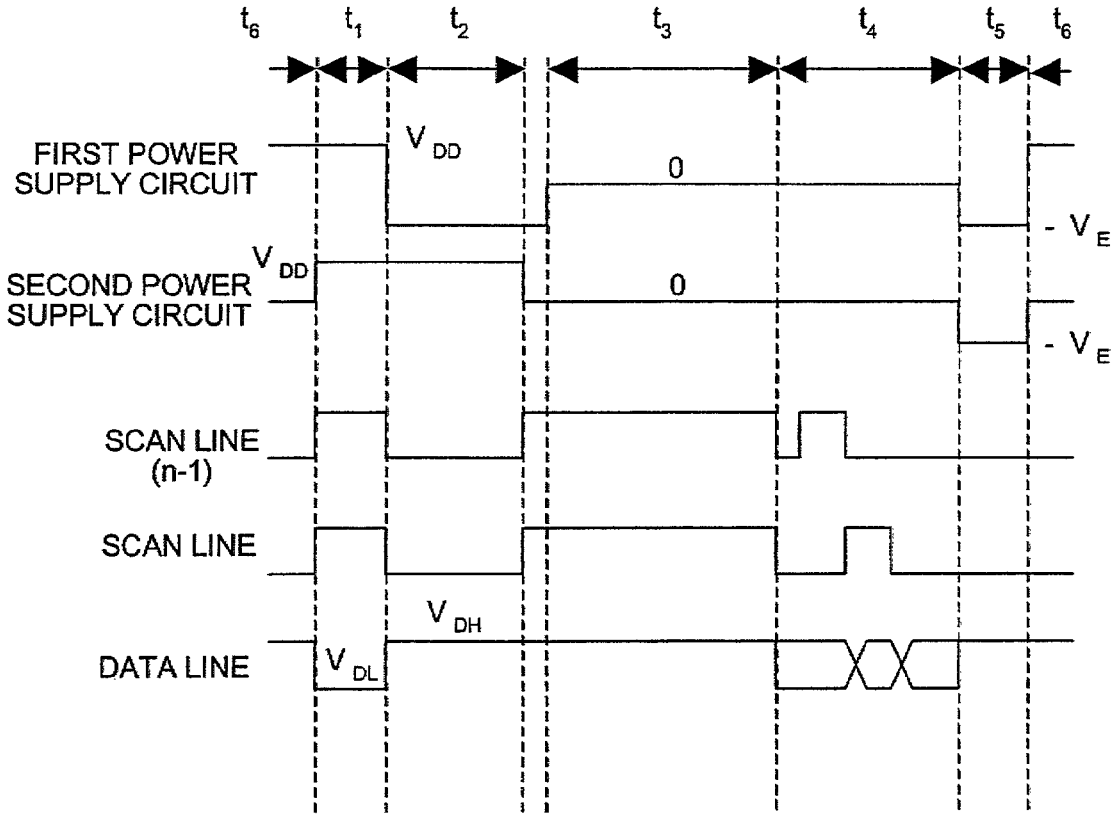
FIG. 7 is a time chart showing modes of potential variations of respective component elements for explanation of the operation of the image display apparatus according to the second embodiment.
Figure 8A:
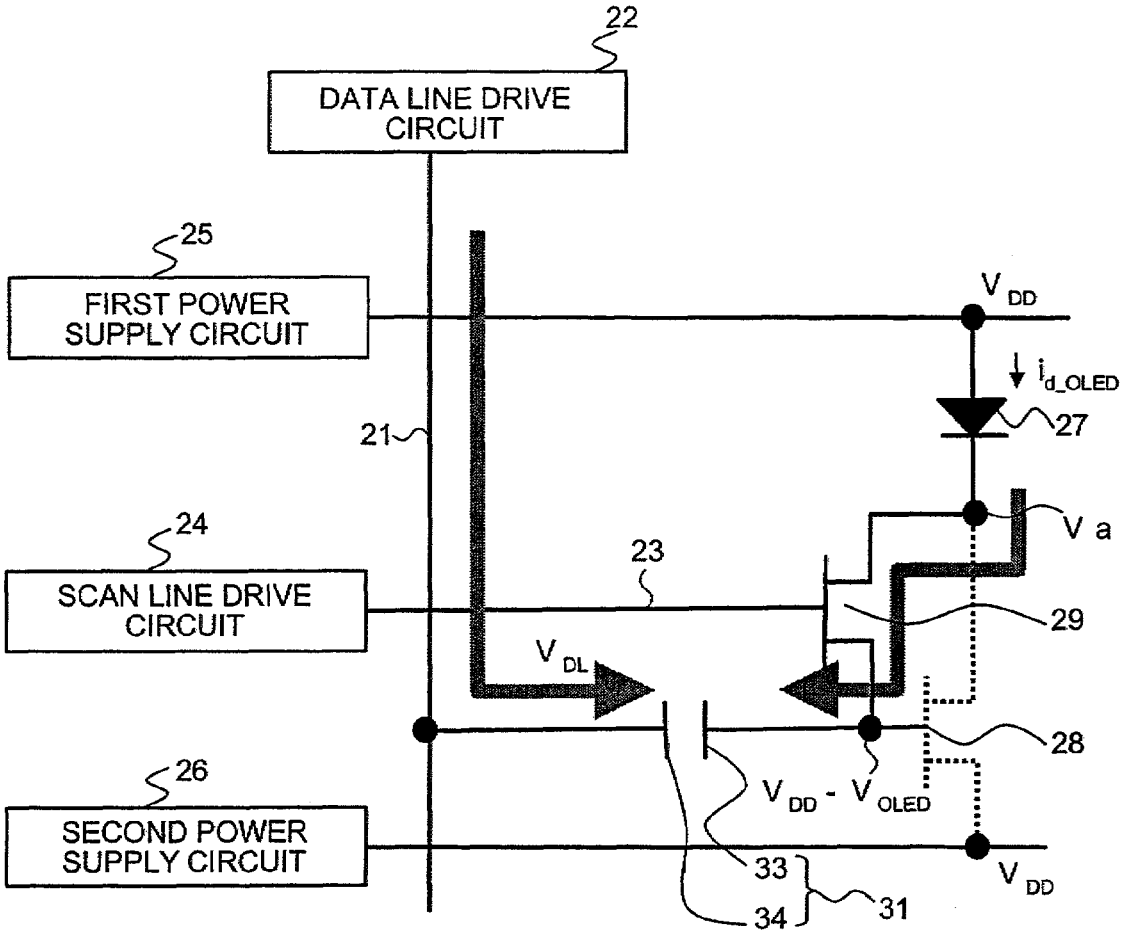
FIG. 8A shows a first reset step of the image display apparatus according to the second embodiment.

FIG. 7 is a time chart showing modes of potential variations of the respective component elements of the image display apparatus according to the second embodiment. In FIG. 7, scan line (n−1) located in the row previous to scan line (n) is shown for reference. FIG. 8A shows a condition of the pixel circuit 20 corresponding to the period $t_1$ shown in FIG. 7, i.e., the reset step.

First, the first reset step of resetting the potential applied to the gate electrode of the driver device 28 at the time of previous light emission is performed. Specifically, as shown by the period $t_1$ in FIG. 7 and FIG. 8A, potentials of the first power supply circuit 25 and the second power supply circuit 26 are set to $V_{DD}$, and the potential of the scan line 23 (scan line drive circuit 24) is set to ON potential.

That is, as shown in FIG. 8A, the switching device 29 is ON. The driver device 28 is OFF because the potential of the second power supply circuit 26 is $V_{DD}$. Accordingly, the potential of a first electrode 33 of the capacitor 31 takes a value obtained by subtracting potential drop $V_{OLED}$ within the light emitting device 27 from the potential $V_{DD}$ supplied from the first power supply circuit 25 to the anode of the light emitting device 27. Since the potential $V_{DD}$ supplied from the first power supply circuit 25 generally has a sufficiently high value, the potential of the first electrode 33 of the capacitor 31 (i.e., the potential of the gate electrode of the driver device 28) is held at $(V_{DD}-V_{OLED})$ having a higher value than the threshold voltage $V_{th}$.

Meanwhile, since the potential of the data line 21 is $V_{DL}$ as shown in FIG. 7, the potential of a second electrode 34 as the other electrode forming the capacitance 31 becomes $V_{DL}$. Accordingly, at the step shown by the period $t_1$ in FIG. 7 and FIG. 8A, the potential $(V_{DD}-V_{OLED})$ is supplied to the first electrode 33, and the potential $V_{DL}$ is supplied to the second electrode 34.

In FIG. 8A, when the switching device 29 is turned ON (the driver device 28 is turned OFF), the potential $(V_{DD}-V_{OLED})$ increases and the potential Va as the potential of the cathode of the light emitting device 27 decreases in a short time and then increases.

Figure 16A:
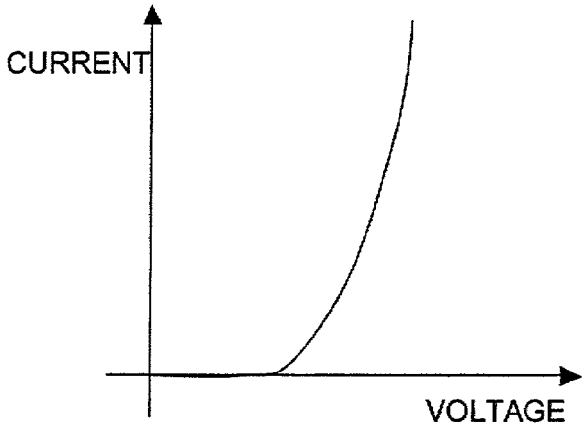
FIG. 16A shows a current-voltage characteristic in a light emitting device (organic EL device)
Figure 16B:
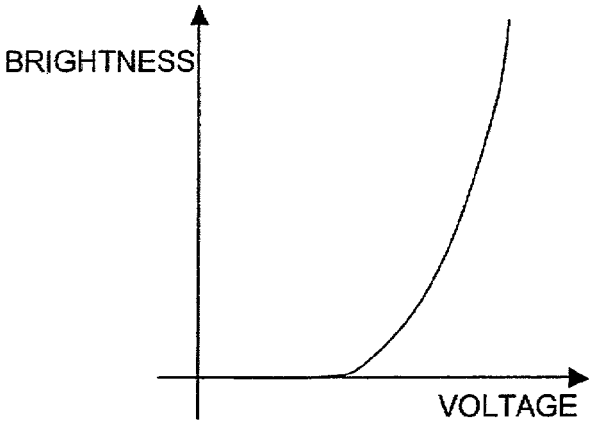
FIG. 16B shows a brightness-voltage characteristic in the light emitting device (organic EL device)

Here, the light emitting device 27 has a current-voltage characteristic to pass current when a potential difference (potential difference between the anode and cathode) equal to or more than threshold voltage $V_{th,i\text{-}v}$ is generated as shown in FIG. 16A. Further, the light emitting device 27 has a brightness-voltage characteristic to emit light (brightness >0) when a potential difference (potential difference between the anode and cathode) equal to or more than threshold voltage $V_{th,L\text{-}v}$ is generated as shown in FIG. 16B.

Further, the threshold voltage $V_{th,i\text{-}v}$ is set to a lower value than the threshold voltage $V_{th,L\text{-}v}$. Accordingly, when the potential difference between the anode and cathode of the light emitting device 27 is equal to or more than the threshold voltage $V_{th,L\text{-}v}$, the light emitting device 27 passes current and emits light. When the potential difference between the anode and cathode of the light emitting device 27 is equal to or more than the threshold voltage $V_{th,i\text{-}v}$ and less than the threshold voltage $V_{th,L\text{-}v}$, a current flows through the light emitting device 27 but no light is emitted.

In the case of FIG. 8A, parameters $C_s$ and $C_{OLED}$ in the above expression (1) are set so that the potential difference between the anode and cathode of the light emitting device 27 (the difference between the $V_{DD}$ from the first power supply circuit 25 and the potential Va) when the potential Va decreases in a short time becomes equal to or more than the above-described threshold value $V_{th,i-v}$ (FIG. 16A) and less than the threshold value $V_{th,L-v}$ (FIG. 16B). The parameter $C_s$ is a value of the capacitor 31 in the second embodiment. The parameter $C_{OLED}$ is a capacitance component of the light emitting device 27.

Accordingly, in FIG. 8A, current $i_{d_OLED}$ flows but with no light emission because the potential difference between the anode and cathode of the light emitting device 27 is equal to or more than the threshold value $V_{th,i-v}$ (FIG. 16A) and less than the threshold value $V_{th,L-v}$ in the first reset step, and thereby, the contrast is improved.

Figure 8B:
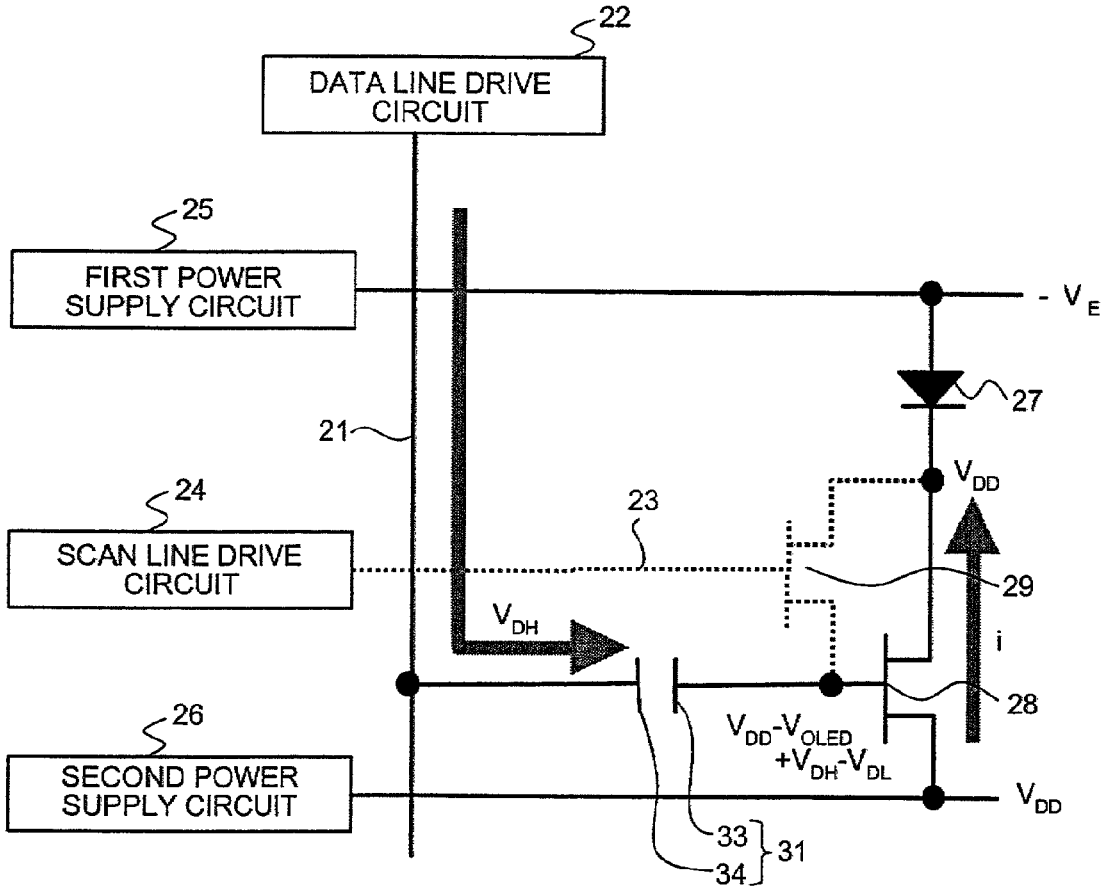
FIG. 8B shows a preparation step of the image display apparatus according to the second embodiment.

Next, as shown by the period $t_2$ in FIG. 7 and FIG. 8B, in the preparation step, when the potential of the first power supply circuit 25 is $-V_E$ ($<V_{th}$), the potential of the data line 21 is $V_{DH}$, the potential of the second power supply circuit 26 is $V_{DD}$, and the potential of the scan line 23 is OFF potential, the potential of the gate electrode of the driver device 28 becomes $V_{DD}-V_{OLED}$ (the potential drop of the light emitting device 27)$+V_{DH}-V_{DL}$ that is higher than the threshold voltage $V_{th}$ of the driver device 28. Further, the switching device 29 is OFF. Thereby, the driver device 28 is turned ON and current i flows.

Figure 8C:
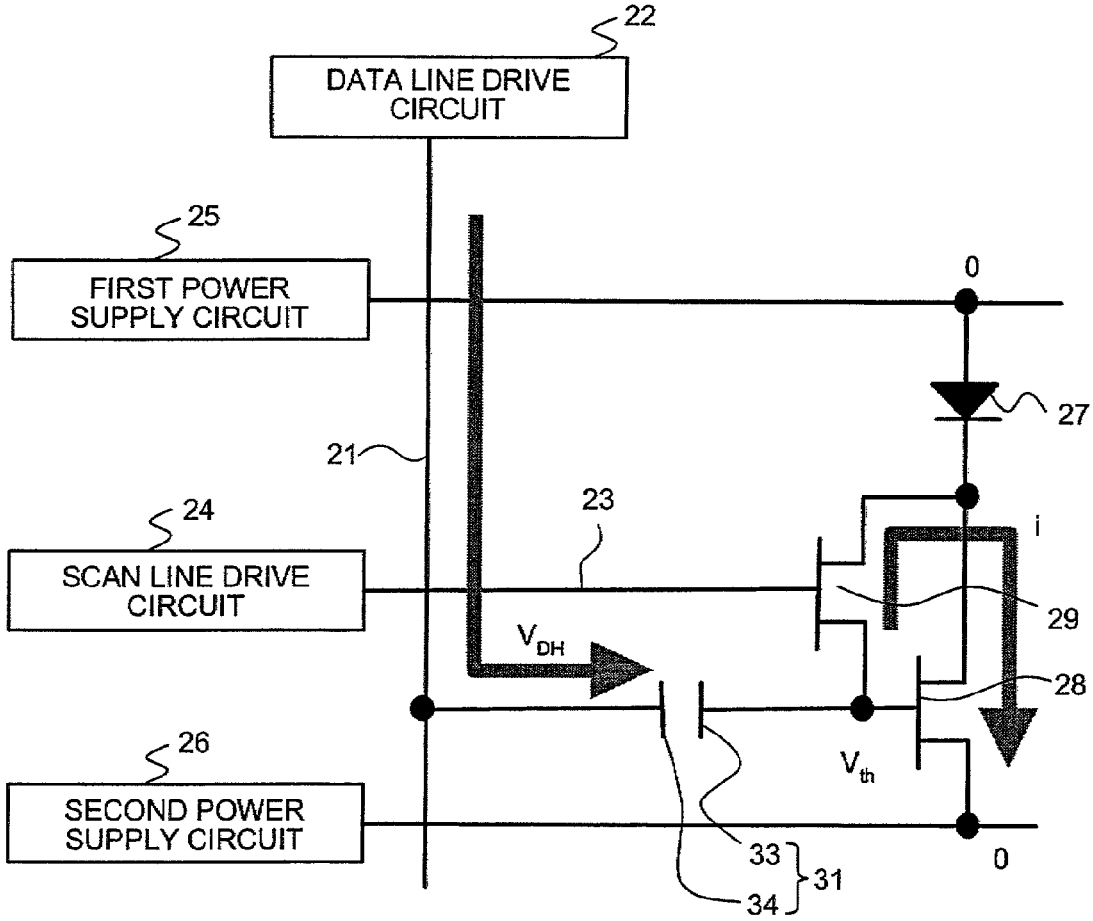
FIG. 8C shows a threshold-voltage detecting step of the image display apparatus according to the second embodiment.

Next, as shown by the period $t_3$ in FIG. 7 and FIG. 8C, in the threshold-voltage detecting step, when the potential of the first power supply circuit 25 is zero potential, the potential of the data line 21 is $V_{DH}$, the potential of the second power supply circuit 26 is zero potential, and the potential of the scan line 23 is ON potential, the switching device 29 is turned ON. Thereby, current i flows via the switching device 29 and the driver device 28.

Figure 8D:
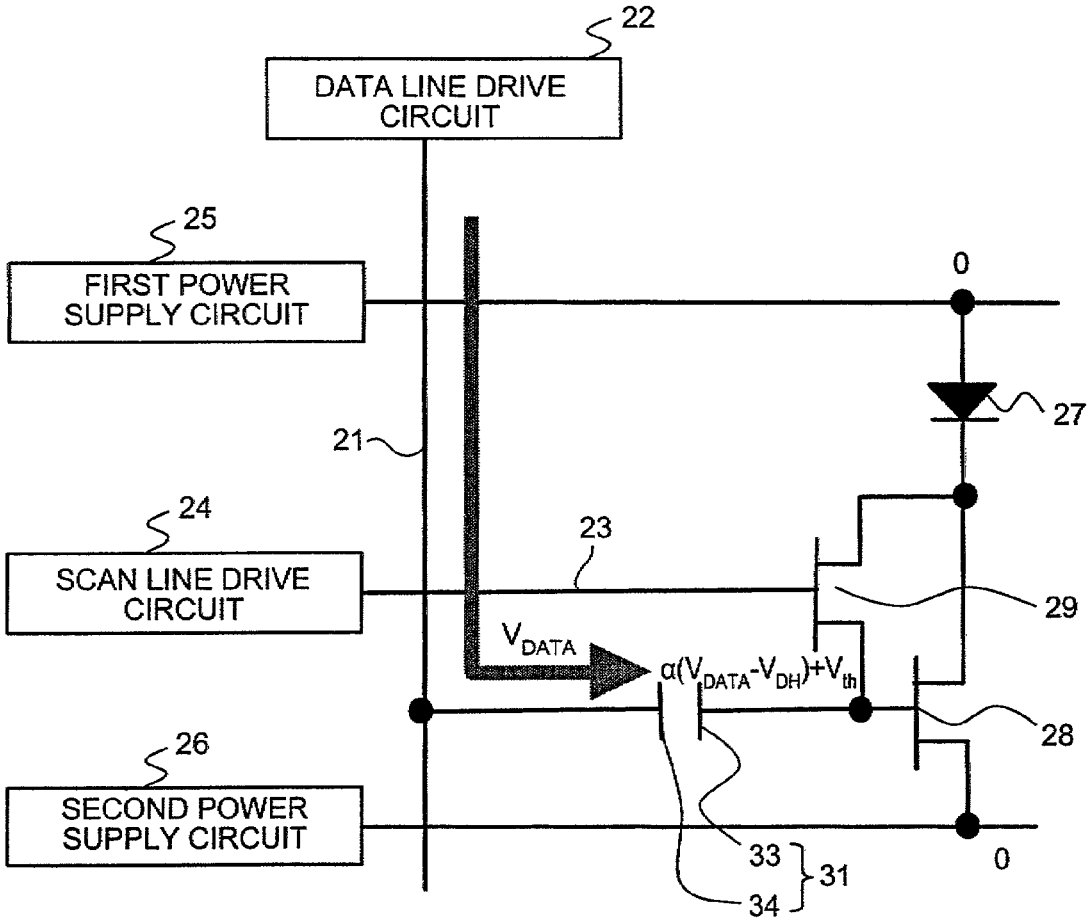
FIG. 8D shows a data-writing step of the image display apparatus according to the second embodiment.

Next, as shown by the period $t_4$ in FIG. 7 and FIG. 8D, in the data-writing step, when the potential of the first power supply circuit 25 is zero potential, brightness potential $V_{DATA}$ is supplied from the data line 21, the potential of the second power supply circuit 26 is zero potential, and the potential of the scan line 23 is ON potential, the switching device 29 is turned ON. Thereby, the potential of the gate electrode of the driver device 28 is set to $\alpha(V_{DATA}-V_{DH})+V_{th}$. $\alpha$ is $C_s/(C_s+C_{OLED})$.

Here, the potential of the cathode electrode of the light emitting device 27 is the same potential as the potential of the gate electrode of the driver device 28 because the switching device 29 is ON.

Figure 8E:
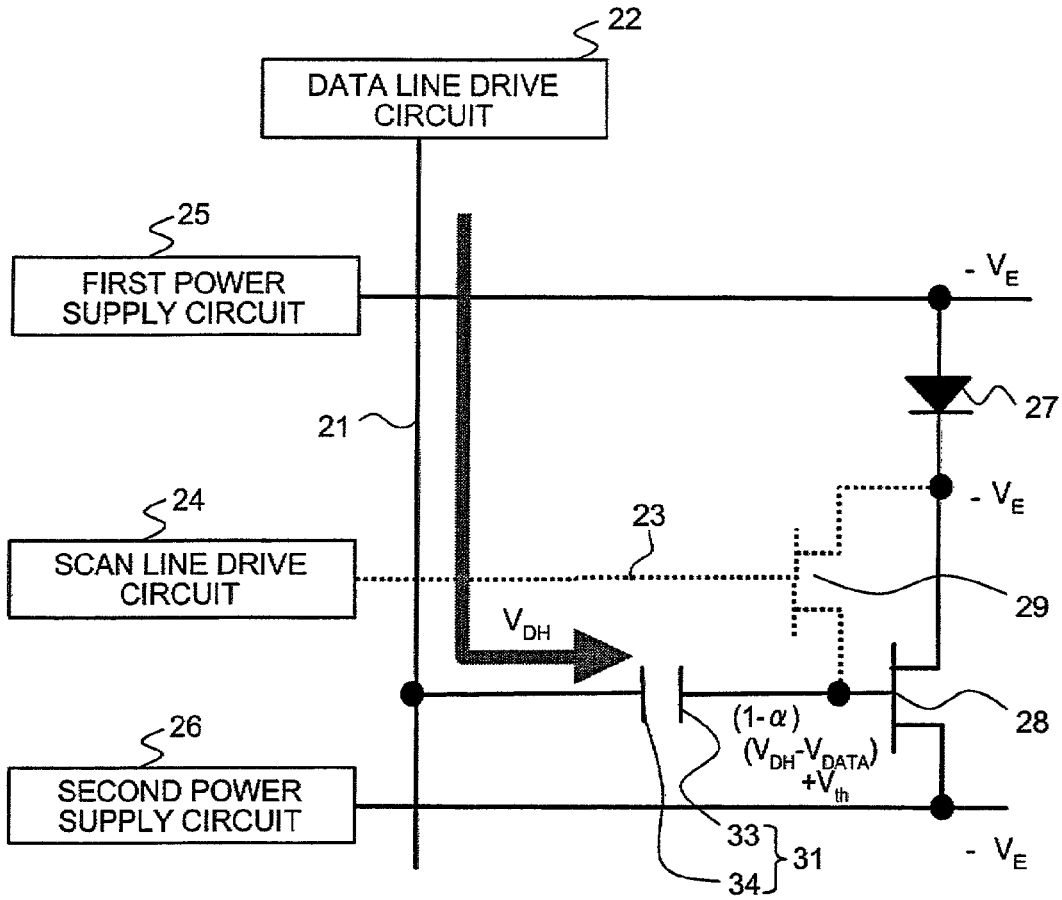
FIG. 8E shows a second reset step of the image display apparatus according to the second embodiment.

Next, as shown by the period $t_5$ in FIG. 7 and FIG. 8E, in the second reset step, when the potential of the first power supply circuit 25 is $-V_E$, the potential of the data line 21 is $V_{DH}$, the potential of the second power supply circuit 26 is $-V_E$, and the potential of the scan line 23 is OFF potential, the switching device 29 is turned OFF. Thereby, the potential of the gate electrode of the driver device 28 is set to $(1-\alpha)(V_{DH}-V_{DATA})+V_{th}$. Through the period $t_5$, the potential of the cathode electrode of the light emitting device 27 is reset to $-V_E$.

Figure 8F:
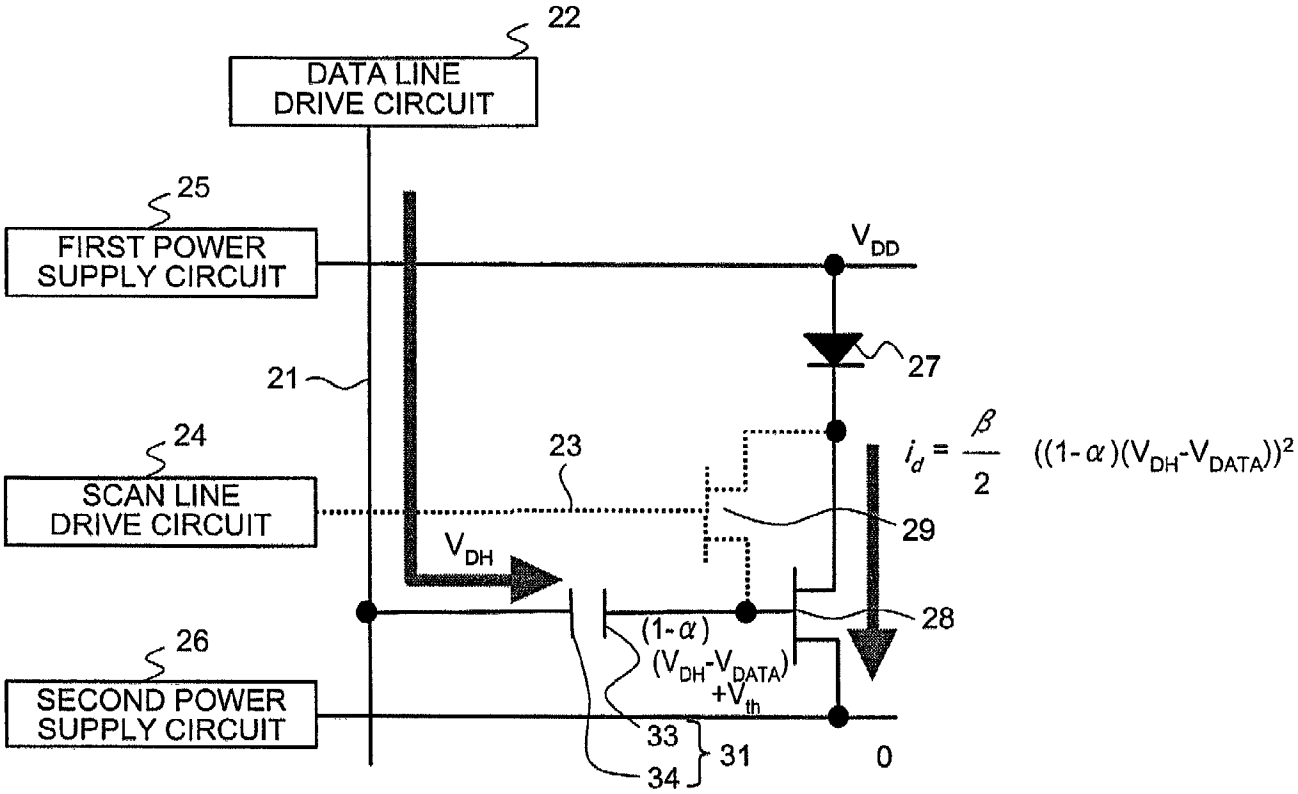
FIG. 8F shows a light-emitting step of the image display apparatus according to the second embodiment.

Next, as shown by the period $t_6$ in FIG. 7 and FIG. 8F, in the light-emitting step, when the potential of the first power supply circuit 25 is $V_{DD}$, the potential of the data line 21 is $V_{DH}$, the potential of the second power supply circuit 26 is zero potential, and the potential of the scan line 23 is OFF potential, current $i_d$ ($=(\beta/2)((1-\alpha)(V_{DH}-V_{data}))^2$) flows through the light emitting device 27 and the light emitting device 27 emits light. Here, the current $i_d$ is independent from the threshold voltage $V_{th}$.

As described above, according to the second embodiment, the apparatus has the driver device 28 for controlling the light emitting device 27 according to the potential difference higher than the predetermined threshold voltage $V_{th}$ applied between the first terminal and the second terminal of the driver device 28, and the switching device 29 for detecting the potential difference corresponding to the threshold voltage $V_{th}$ between the first terminal and the second terminal of the driver device 28. In addition, $-V_E$ (see FIGS. 7 and 8E) as potential lower than the threshold voltage $V_{th}$ at the time of detection of the threshold voltage performed in the prior step than the light-emitting step is supplied to the driver device 28 and the light emitting device 27 before the light-emitting step. Furthermore, at the light-emitting step, the light emitting device 27 emits light and supplies the potential for allowing the current $i_d$ independent from the threshold voltage $V_{th}$ in the light-emitting step (see FIG. 8F). Therefore, the definition can be improved even when the two-TFT configuration which has only two TFTs in each of the pixels is adopted.

Figure 9:
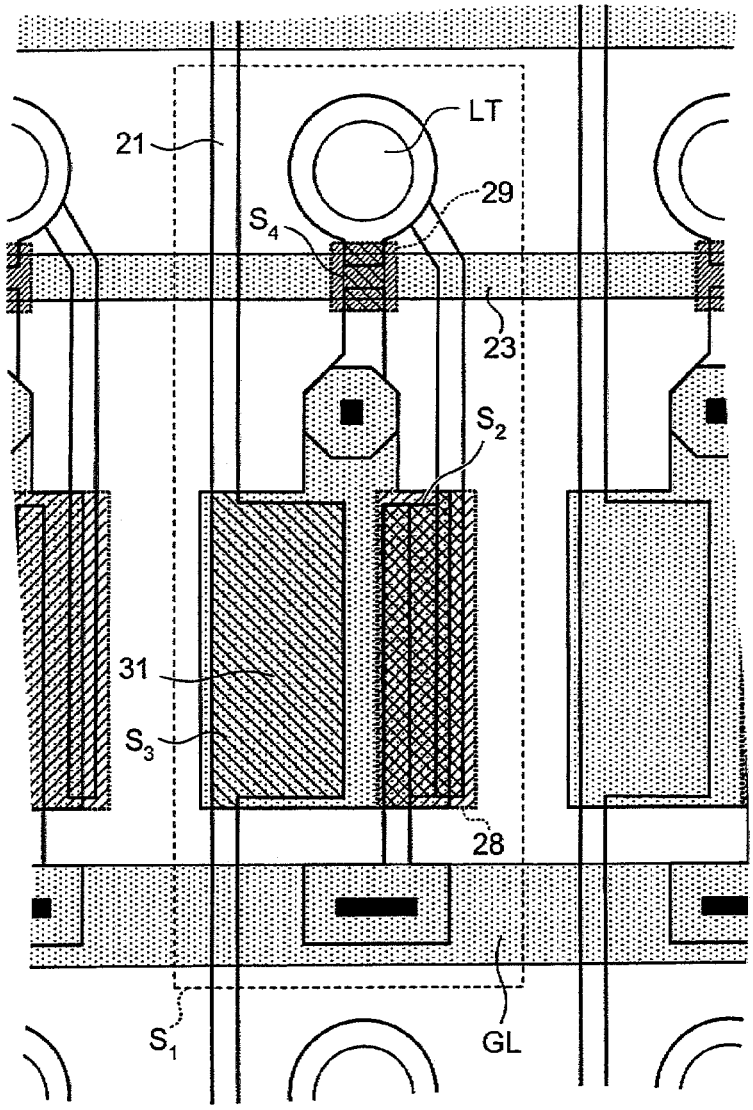
FIG. 9 is an enlarged plan view of the image display apparatus in FIG. 6.

FIG. 9 is an enlarged plan view of the image display apparatus of the second embodiment. The layout of the layers below a lower electrode (not shown) of the light emitting device 27 is shown in the drawing. Two TFTs (the driver device 28 and the switching device 29) and the capacitor 31 are shown within one pixel. The driver device 28 is located away from the capacitor 31 so that they do not overlap in a plane view. The driver 28 and the capacitor 31 are located on substantially the same plane. The layers forming each device are a lower electrode layer (an area filled with a dot pattern in the drawing), an insulating layer (an area other than the portions filled with black in the drawing), an active layer (a shaded area in the drawing), and an upper electrode layer (a white area surrounded by a solid line) from the bottom layer. One end of the light emitting device 27 is connected to the terminal LT in the drawing.

The lower electrode layer is formed on a substrate and includes the gate electrode of the driver device 27, the gate electrode (scan line 23) of the switching device 29, power supply line GL connected to the second power supply circuit 26, and the first electrode 33 of the capacitor 31. The insulating layer is formed on the entire surface except two openings on the lower electrode layer. The insulating layer functions as a gate insulating film for the two TFTs and as a dielectric layer for the capacitor 31. The active layer is formed on the insulating layer and includes active layers of the two TFTs. The upper electrode layer is formed on the active layer and includes source and drain electrodes of the two TFTs, the second electrode 34 of the capacitor 31, and the data line 21.

Further, the insulating layer has an opening for connecting the power supply line connected to the second power supply circuit 26 and the source electrode of the driver device 28 and an opening for connecting both the first electrode 33 of the capacitor 31 and the gate electrode of the driver device 28 to the drain electrode of the switching device 29, and the upper and lower layers are electrically connected through these openings. The constituent materials of the respective layers are the same as those of the first embodiment.

As can be seen from the same drawing, in the second embodiment, since the compensation of the threshold voltage $V_{th}$ of the driver device 28 can be realized by the two TFTs, the areas of the driver device 28 and the capacitor 31 can be made larger than in the case of the first embodiment. In the second embodiment, the size for one pixel is 51 μm×153 μm, $S_2/S_1$ of about 0.15 and $S_3/S_1$ of about 0.14 are ensured.

Figure 10:
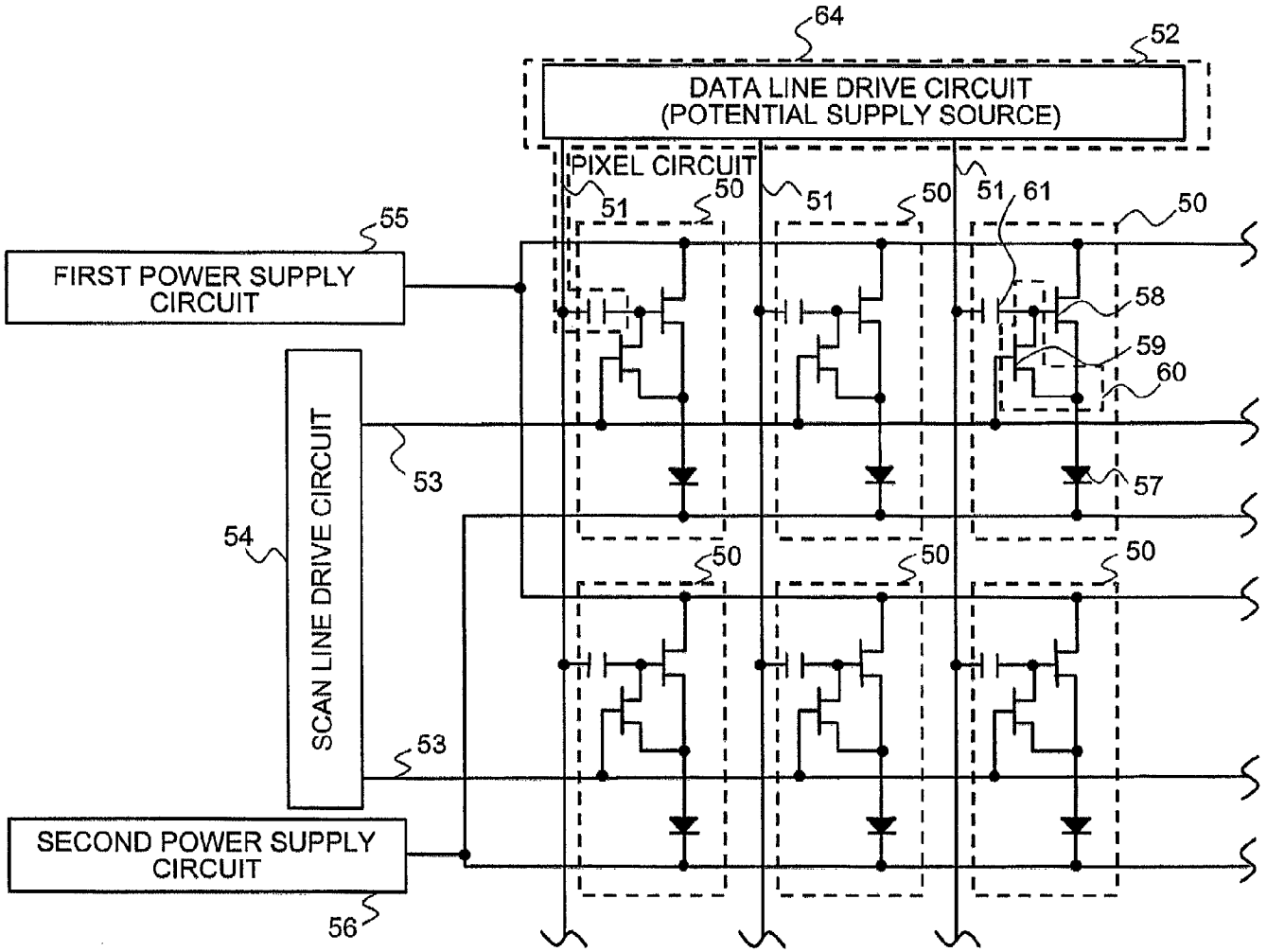
FIG. 10 shows an overall configuration of an image display apparatus according to a third embodiment of the invention.

FIG. 10 shows an overall configuration of an image display apparatus according to a third embodiment of the invention. The image display apparatus shown in FIG. 10 includes plural pixel circuits 50 arranged in a matrix form, a data line drive circuit 52 for supplying brightness signals to the plural pixel circuits 50 via plural data lines 51, and a scan line drive circuit 54 for supplying scan signals to the pixel circuits 50 via plural scan lines 53. The scan signals are signals for selection of pixel circuits 50 to which brightness signals are to be supplied. The image display apparatus has two-TFT configuration in each pixel.

Further, the image display apparatus includes a first power supply circuit 55 for supplying a potential to the drain of a driver device 58 and a second power supply circuit 56 for supplying a potential to the cathode of a light emitting device 57.

The pixel circuit 50 includes the light emitting device 57 with the cathode side electrically connected to the second power supply circuit 56, the driver device 58 with a drain electrode connected to the first power supply circuit 55, and a threshold potential detecting unit 60 comprising a switching device 59 that controls the conduction state between the gate and source of the thin-film transistor forming the driver device 58.

The light emitting device 57 has a mechanism of emitting light by current injection and consists of the above-described organic EL device. The driver device 58 has a function of controlling current flowing through the light emitting device 57. Specifically, the driver device 58 has a function of controlling current flowing through the light emitting device 57 according to the potential difference equal to or more than the drive threshold value applied between a first terminal and a second terminal of the driver device 58, and a function of keeping the current flow through the light emitting device 57 during application of the potential difference. In the third embodiment, the driver device 58 consists of an n-type thin-film transistor and controls the light emitting device 57 according to the potential difference applied between a gate electrode corresponding to the first terminal and a source electrode corresponding to the second terminal.

A capacitor 61 forms a brightness potential/reference potential supply unit 64 by combination with the data line drive circuit 52. The brightness potential/reference potential supply unit 64 has a function, as brightness potential supply means, of supplying emission brightness voltage corresponding to the brightness of the driver device 58 and a function of supplying a reference potential.

Figure 11:
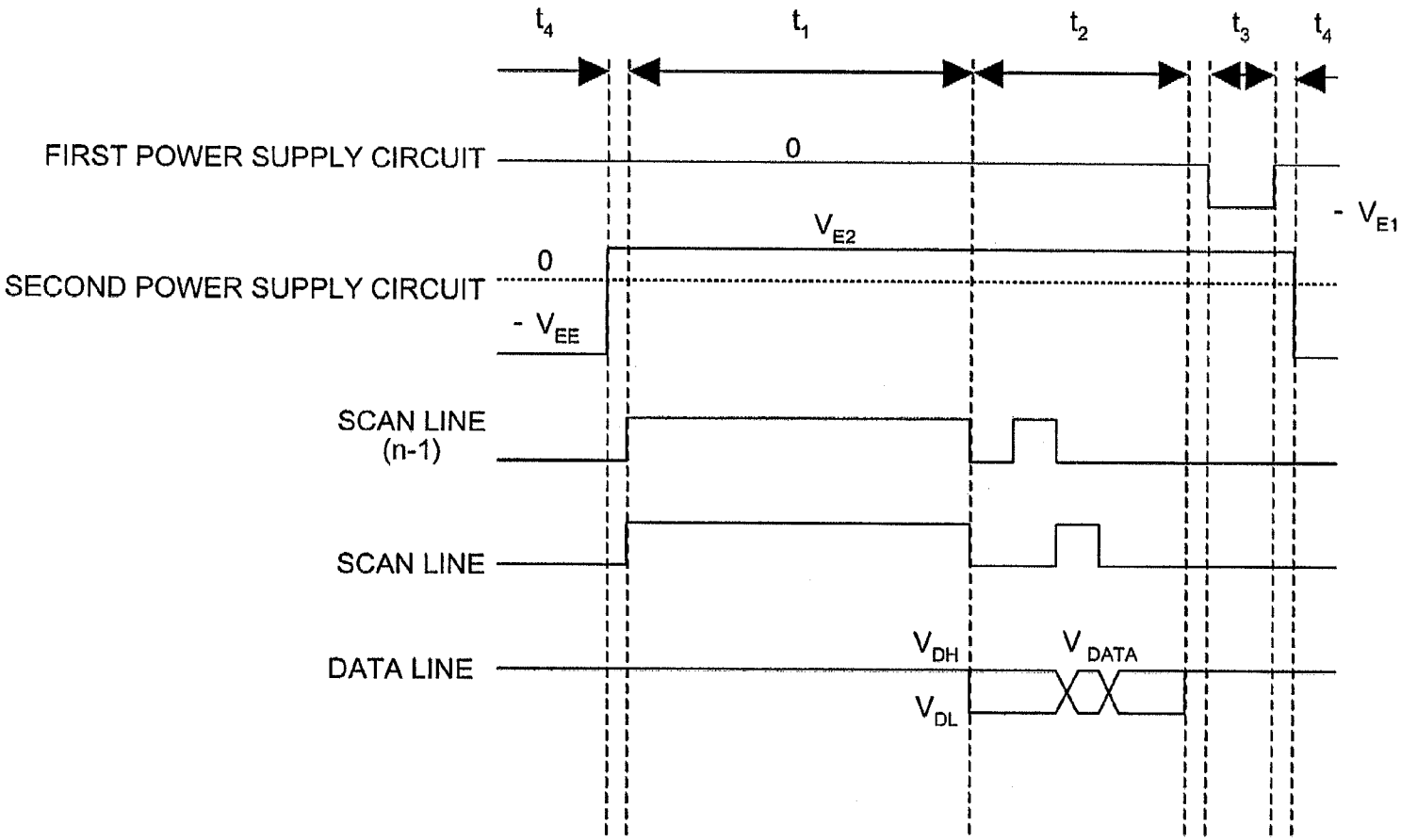
FIG. 11 is a time chart showing modes of potential variations of respective component elements for explanation of the operation of the image display apparatus according to the third embodiment.
Figure 12A:
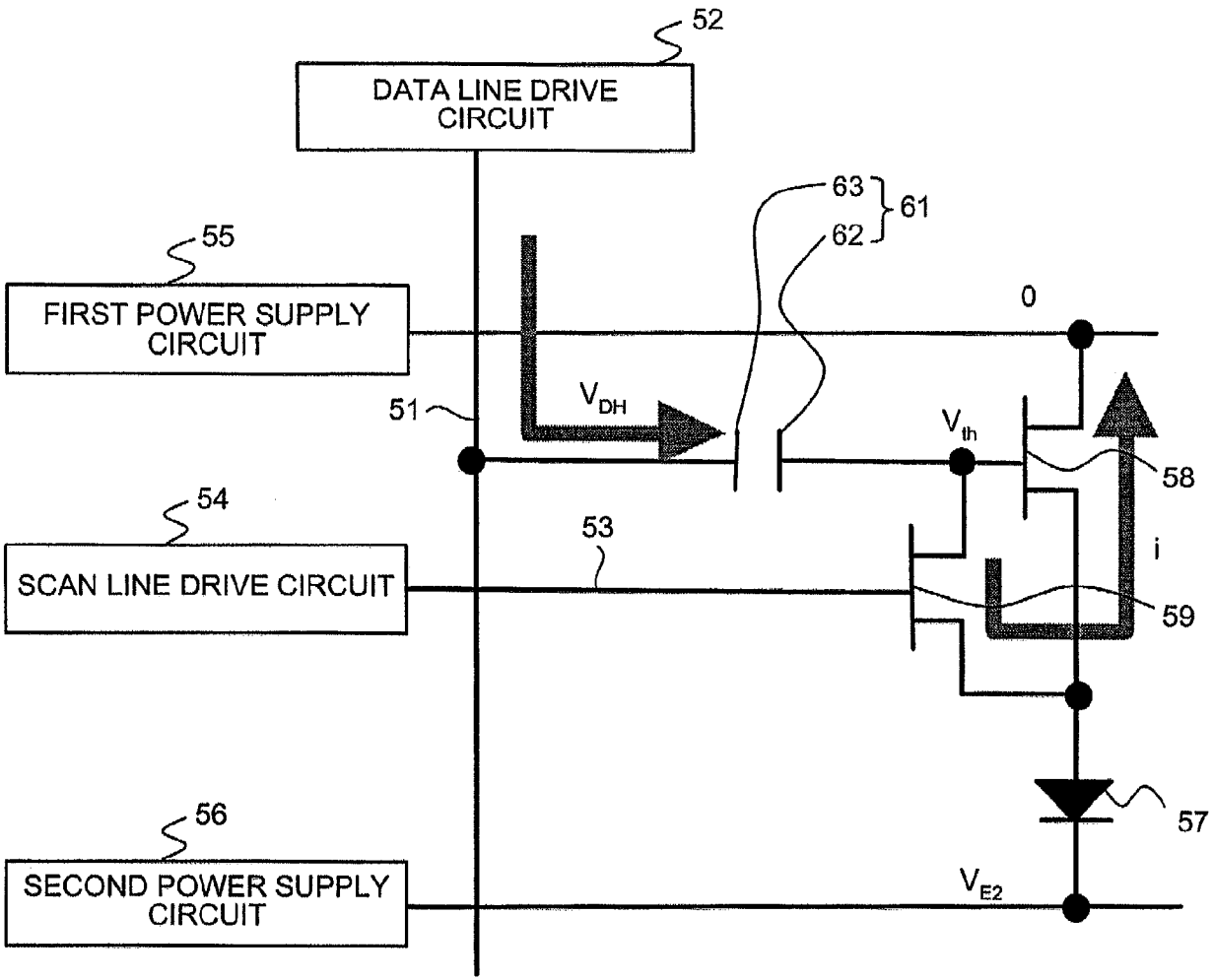
FIG. 12A shows a threshold-voltage detecting step of the image display apparatus according to the third embodiment.

FIG. 11 is a time chart showing modes of potential variations of the respective component elements of the image display apparatus according to the third embodiment. In FIG. 11, scan line (n−1) located in the row previous to scan line (n) is shown for reference. FIG. 12A corresponds to the period $t_1$ shown in FIG. 11, i.e., the threshold voltage detecting step.

Specifically, as shown by the period $t_1$ in FIG. 11 and FIG. 12A, at the threshold voltage detecting step, when the potential of the first power supply circuit 55 is zero potential, the potential of the data line 51 is $V_{DH}$, the potential of the second power supply circuit 56 is $V_{E2}$, and the potential of the scan line 53 is ON potential, the switching device 59 is turned ON. Thereby, current i flows via the switching device 59 and the driver device 58.

Figure 12B:
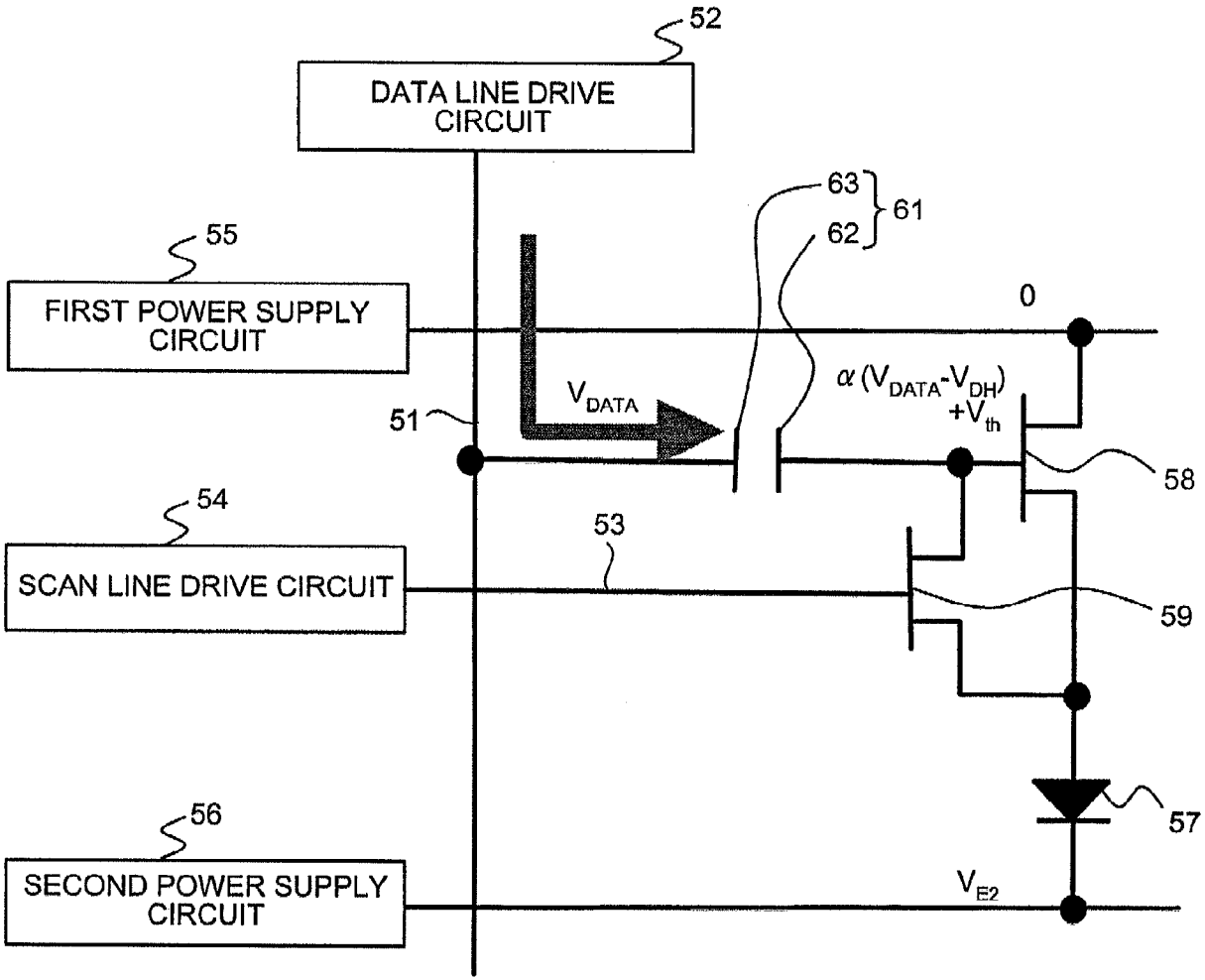
FIG. 12B shows a data-writing step of the image display apparatus according to the third embodiment.

Next, as shown by the period $t_2$ in FIG. 11 and FIG. 12B, in data-writing step, when the potential of the first power supply circuit 55 is zero potential, brightness potential $V_{DATA}$ is supplied from the data line 51, the potential of the second power supply circuit 56 is $V_{E2}$, and the potential of the scan line 53 is ON potential, the switching device 59 is turned ON. Thereby, the potential of the gate electrode of the driver device 58 is set to $\alpha(V_{DATA}-V_{DH})+V_{th}$. $\alpha$ is $C_s/(C_s+C_{OLED})$.

Figure 12C:
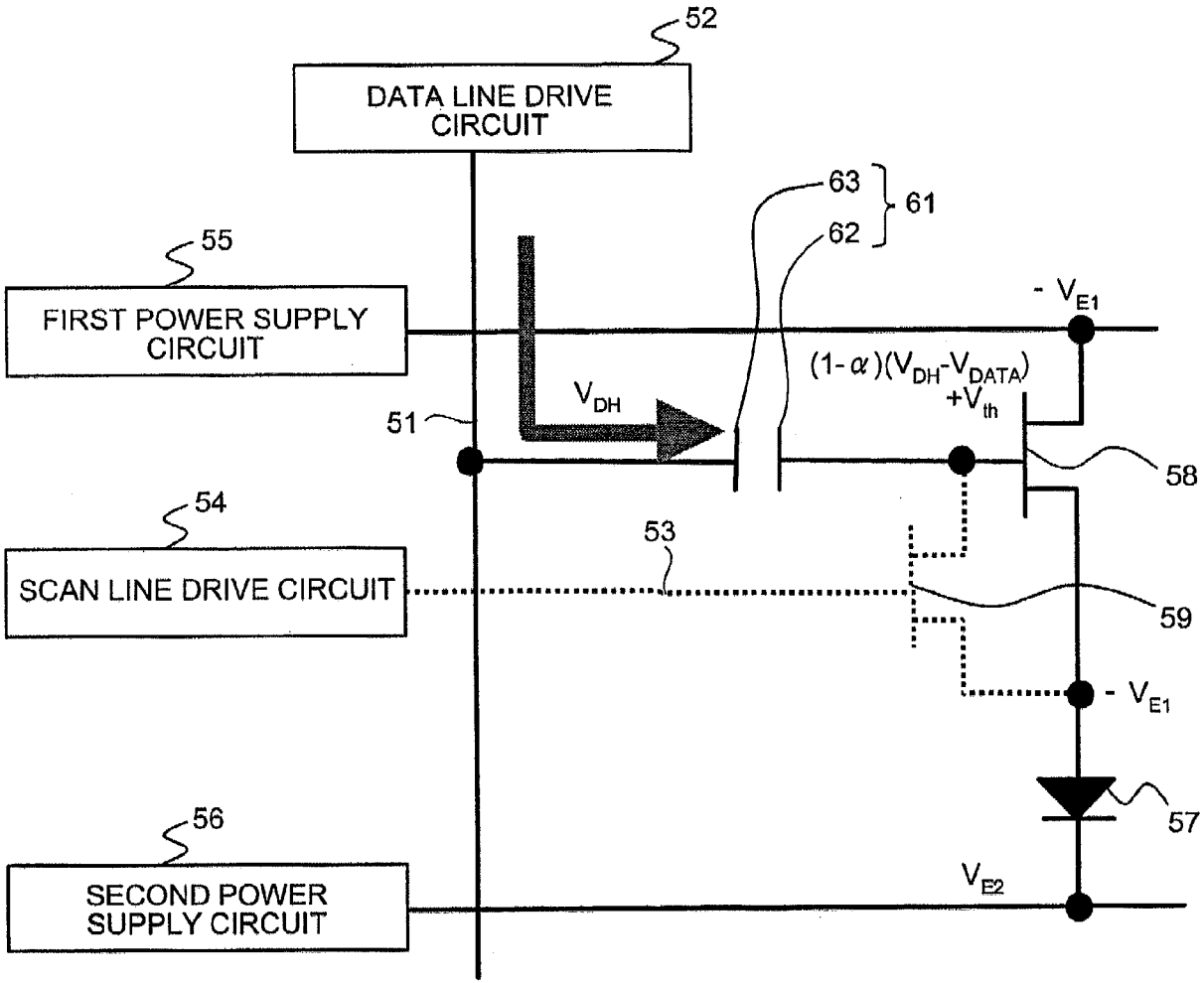
FIG. 12C shows a reset step of the image display apparatus according to the third embodiment.

Next, as shown by the period $t_3$ in FIG. 11 and FIG. 12C, in the reset step, when the potential of the first power supply circuit 55 is $-V_{E1}$ ($<-V_{th}$), the potential of the data line 51 is $V_{DH}$, the potential of the second power supply circuit 56 is $V_{E2}$, and the potential of the scan line 53 is OFF potential, the switching device 59 is turned OFF. Thereby, the potential of the gate electrode of the driver device 58 is set to $(1-\alpha)(V_{DH}-V_{DATA})+V_{th}$. Through the period $t_3$, the potential of the anode electrode of the light emitting device 57 is reset to $-V_{E1}$.

Figure 12D:
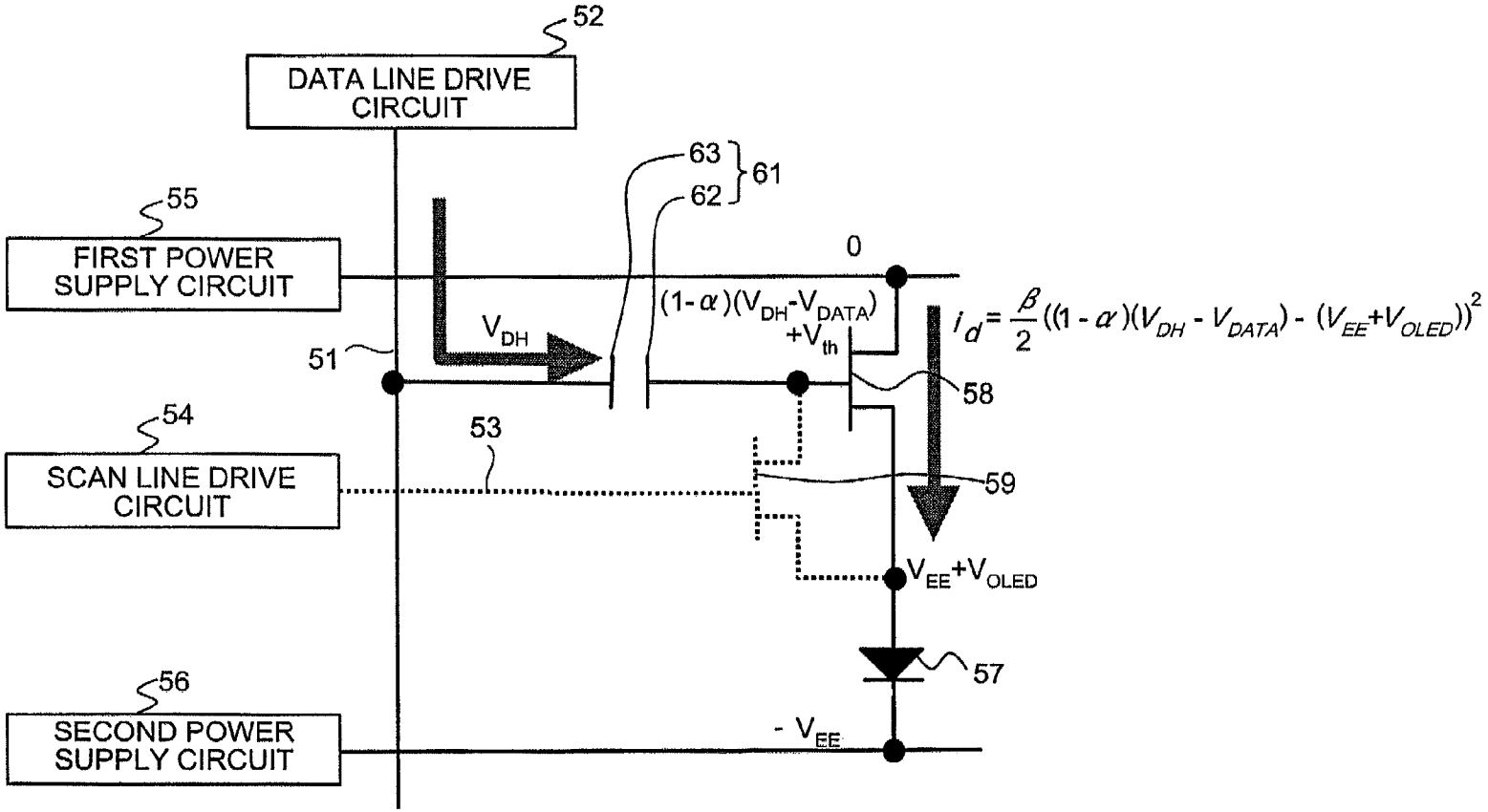
FIG. 12D shows a light-emitting step of the image display apparatus according to the third embodiment.

Next, as shown by the period $t_4$ in FIG. 11 and FIG. 12D, at the light-emitting step, when the potential of the first power supply circuit 55 is zero potential, the potential of the data line 51 is $V_{DH}$, the potential of the second power supply circuit 56 is $-V_{EE}$, and the potential of the scan line 53 is OFF potential, current $i_d$ $(=(\beta/2)(1-\alpha)(V_{DH}-V_{data})-(V_{EE}+V_{OLED}))^2)$ flows through the light emitting device 57 and the light emitting device 57 emits light. Here, the current $i_d$ is independent from the threshold voltage $V_{th}$ of the driver device 58.

Figure 13A:
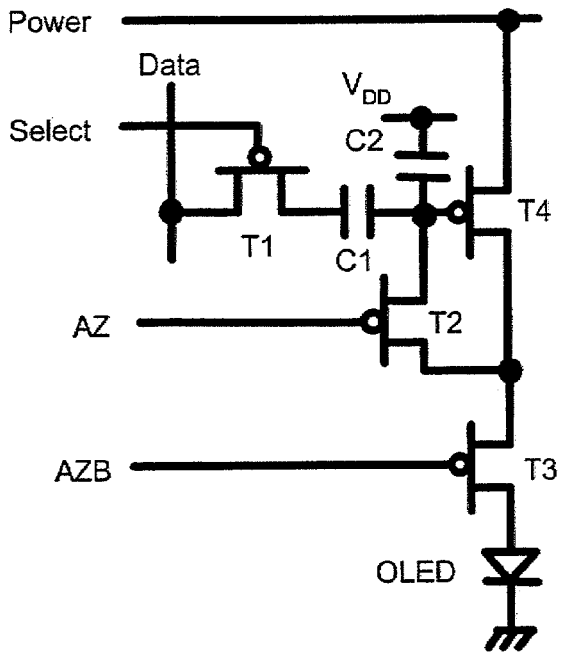
FIG. 13A shows a configuration of a main part of an image display apparatus according to a fourth embodiment.
Figure 13B:
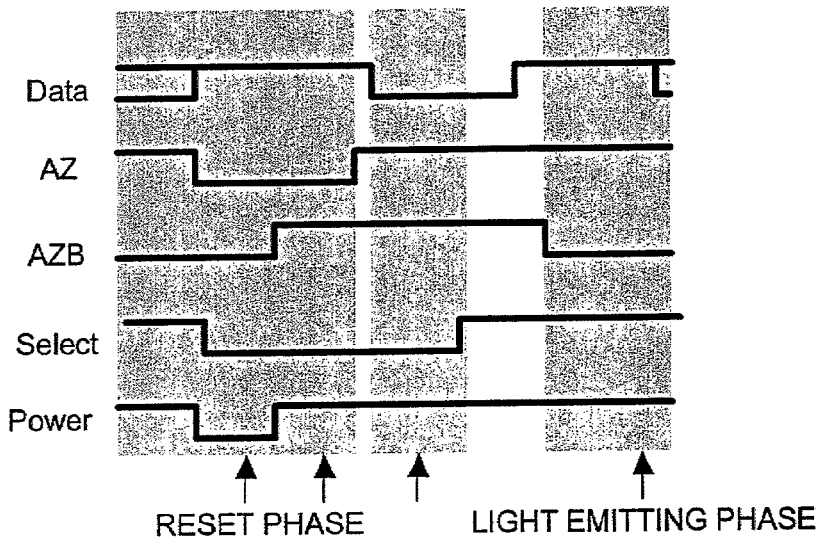
FIG. 13B is a time chart for explanation of the operation of the image display apparatus according to the fourth embodiment.

A function of preventing light emission in the reset step may be applied to image display apparatus having the configurations shown in FIGS. 13A and 14A. The image display apparatus shown in FIG. 13A (a fourth embodiment) is comprised by arranging a switching device T1, a switching device T2, a switching device T3, a driver device T4, a capacitor C1, a capacitor C2, and a light emitting device OLED as illustrated and operates according to a timing chart shown in FIG. 13B.

The switching devices T1 to T3 and the driver device T4 are p-type thin-film transistors. In the reset step, Power (OFF potential) is supplied to the driver device T4. In this case, since the cathode of the light emitting device OLED is grounded at OFF potential, the driver device T4 is turned OFF and the switching device T2 is turned ON. In this case, the light emitting device OLED passes current but emits no light as is the case of the first embodiment.

Further, the image display apparatus shown in FIG. 14A (a fifth embodiment) has a configuration that a switching device T1', a switching device T2', a switching device T3', a driver device T4', a capacitor C1', a capacitor CT, and light emitting device OLED' are arranged as illustrated, and operates according to a timing chart shown in FIG. 14B.

The switching devices T1' to T3' and the driver device T4' are n-type thin-film transistors. In the reset step, Power (ON potential) is supplied to the driver device T4'. In this case, since ON potential $V_{DD}$ is supplied to the anode of the light emitting device OLED, the driver device T4' is turned OFF and the switching device T2' is turned ON. In this case, a current flows through the light emitting device OLED' but no light is emitted as is the case of the first embodiment.

As described above, according to the fourth and fifth embodiments, the same effect as that of the first embodiment is exerted. Although the cases that satisfy the above expression (1) are described in the first to fifth embodiments, even when the above expression (1) is not satisfied in the first to fifth embodiments, since the driver device is OFF in the reset step, the amount of current passing through the light emitting device becomes smaller compared to that in the conventional case and the amount of light emission of the light emitting device can be made smaller, and thereby, the contrast can be made higher than that in the conventional case.

Further effects and modified examples can be readily derived by one skilled in the art. Accordingly, broader aspects of the invention are not limited by the specific details and representative embodiments that are shown and described above. Therefore, various changes can be made without departing from the sprit and scope of the general concept of the invention defined by the accompanying claims and the equivalent thereof.

For example, in the first and second embodiments, the potential $V_r$ higher than the drive threshold value $V_{th}$ are supplied to the gate electrode of the drive transistor. However, the potential $V_r$ is not necessarily higher than the drive threshold value $V_{th}$, but preferably higher than the drive threshold value $V_{th}$. When the potential $V_r$ is lower than the drive threshold value $V_{th}$, the potential difference between the gate and source of the drive transistor in the early period of the threshold-voltage detecting step is made larger by adjusting the source potential, data line potential, etc. of the drive transistor in the early period of the threshold-voltage detecting step.

What is claimed is:

1. An image display apparatus, comprising:

a plurality of pixels, each pixel having a light emitting device, a drive transistor electrically connected to the light emitting device, a capacitor that has a first electrode and a second electrode, the first electrode being electrically connected to a gate electrode of the drive transistor and the second electrode being electrically connected to a data line for supplying a brightness potential, and a driving controller configured to control a potential difference to both ends of the light emitting device being equal to or more than a first threshold voltage of the light emitting device at which current starts to flow through the light emitting device, and equal to or less than a second threshold voltage of the light emitting device at which light emission is started in the light emitting device when a potential applied to the gate electrode of the driver transistor for previous light emission is reset, wherein the driving controller comprises at least one of a data line drive circuit, a first power supply circuit, a second power supply circuit, a drive control circuit, and a scan line drive circuit, and wherein a ratio of an area occupied by the drive transistor per one pixel to an area of the one pixel is equal to or more than 0.05.

2. The image display apparatus according to claim 1, wherein the ratio is equal to or less than 0 25.

3. The image display apparatus according to claim 1, wherein each pixel has another transistor other than the drive transistor, and a ratio of an area of the drive transistor to an area of the another transistor is 2 to 10.

4. The image display apparatus according to claim 1, wherein a ratio of an area occupied by the capacitor per one pixel to an area of the one pixel is equal to or more than 0.05.

5. The image display apparatus according to claim 4, wherein the ratio of an area occupied by the capacitor per one pixel to an area of the one pixel is equal to or less than 0.25.

6. The image display apparatus according to claim 1, wherein the drive transistor is an amorphous silicon transistor.

7. The image display apparatus according to claim 1, wherein an area of the one pixel is 7000 $\mu m^2$ to 50000 $\mu m^2$.

8. The image display apparatus according to claim 1, wherein the light emitting device is an organic EL device.

9. The image display apparatus according to claim 1, wherein a number of transistors included in each pixel is three.

10. An image display apparatus, comprising:

a plurality of pixels, each pixel having a light emitting device, a drive transistor electrically connected to the light emitting device, a capacitor that has a first electrode and a second electrode, the first electrode being electrically connected to a gate electrode of the drive transistor and the second electrode being electrically connected to a data line for supplying a brightness potential, the drive transistor and the capacitor not overlapping, and a driving controller configured to control a potential difference to both ends of the light emitting device being equal to or more than a first threshold voltage of the light emitting device at which current starts to flow through the light emitting device, and equal to or less than a second threshold voltage of the light emitting device at which light emission is started in the light emitting device when a potential applied to the gate electrode of the driver transistor for previous light emission is reset, wherein the driving controller comprises at least one of a data line drive circuit, a first power supply circuit, a second power supply circuit, drive control circuit, and a scan line drive circuit, and wherein a ratio of an area occupied by the capacitor per one pixel to an area of the one pixel is equal to or more than 0.05.

11. The image display apparatus according to claim 10, wherein the ratio is equal to or less than 0.25.

12. The image display apparatus according to claim 10, wherein the drive transistor and the capacitor are located on a substantially same plane.

13. The image display apparatus according to claim 10, wherein the drive transistor is an amorphous silicon transistor.

14. The image display apparatus according to claim 10, wherein an area of the one pixel is 7000 $\mu m^2$ to 50000 $\mu m^2$.

15. The image display apparatus according to claim 10, wherein the light emitting device is an organic EL device.

16. The image display apparatus according to claim 10, wherein a number of transistors included in each pixel is three.

17. An image display apparatus, comprising:

a plurality of pixels, each pixel having a light emitting device, a drive transistor electrically connected to the light emitting device, a capacitor electrically connected to the drive transistor, and a driving controller that controls a potential difference to both ends of the light emitting device being equal to or more than a first threshold voltage of the light emitting device at which current starts to flow through the light emitting device, and equal to or less than a second threshold voltage of the light emitting device at which light emission is started in the light emitting device when a potential applied to the gate electrode of the driver transistor for previous light emission is reset, wherein the driving controller comprises at least one of a data line drive circuit, a first power supply circuit, a second power supply circuit, drive control circuit, and a scan line drive circuit.

18. The image display apparatus according to claim 17, further comprising:

a first switching transistor that electrically connects the gate electrode of the drive transistor and either a source electrode or the drain electrode of the drive transistor according to a scan signal.

19. The image display apparatus according to claim 17, wherein the drive transistor is set OFF when the potential applied to the gate electrode of the driver transistor for previous light emission is reset.

20. The image display apparatus according to claim 17, wherein the drive transistor and the capacitor are not overlapped.

* * * * *